US009370266B2

(12) United States Patent
Best et al.

(10) Patent No.: US 9,370,266 B2
(45) Date of Patent: Jun. 21, 2016

(54) METHOD AND APPARATUS OF MOUNTING ADVERTISING TO A DISPLAY

(71) Applicant: Best Fit Frames, LLC, Wisconsin Rapids, WI (US)

(72) Inventors: Benjamin A. Best, Nekoosa, WI (US); George Parke, IV, La Crosse, WI (US); Christopher M. Wareham, Woodbury, MN (US)

(73) Assignee: Best Fit Frames, LLC, Wisconsin Rapids, WI (US)

( * ) Notice: Subject to any disclaimer, the term of this patent is extended or adjusted under 35 U.S.C. 154(b) by 0 days.

(21) Appl. No.: 14/513,657

(22) Filed: Oct. 14, 2014

(65) Prior Publication Data

US 2015/0027016 A1 Jan. 29, 2015

Related U.S. Application Data

(63) Continuation-in-part of application No. 14/109,500, filed on Dec. 17, 2013, which is a continuation-in-part of application No. 13/904,335, filed on May 29, 2013.

(60) Provisional application No. 61/660,751, filed on Jun. 17, 2012, provisional application No. 61/792,764, filed on Mar. 15, 2013.

(51) Int. Cl.

| | |
|---|---|
| ***A47G 1/06*** | (2006.01) |
| ***G09F 23/00*** | (2006.01) |
| ***G09F 9/30*** | (2006.01) |
| ***G09F 7/18*** | (2006.01) |

(52) U.S. Cl.

CPC ..... *A47G 1/0627* (2013.01); *G09F 7/18* (2013.01); *G09F 9/30* (2013.01); *G09F 23/00* (2013.01); *Y10T 29/49826* (2015.01)

(58) Field of Classification Search

CPC ..... G06F 1/1607; G06F 1/1601

See application file for complete search history.

(56) References Cited

U.S. PATENT DOCUMENTS

| | | | | |
|---|---|---|---|---|
| 4,883,397 | A | 11/1989 | Dubost | |
| 4,937,958 | A | 7/1990 | Stein et al. | |
| 5,175,627 | A | 12/1992 | Josephs | |
| 5,269,083 | A * | 12/1993 | Vampatella et al. | 40/711 |
| 5,398,905 | A | 3/1995 | Hinson | |

(Continued)

FOREIGN PATENT DOCUMENTS

| | | |
|---|---|---|
| CN | 102013211 A | 4/2011 |
| GB | 2475591 A | 3/2009 |

OTHER PUBLICATIONS www.screen-wear.com, website accessed Nov. 22, 2013—(1 page).

*Primary Examiner* — Shin Kim

(74) *Attorney, Agent, or Firm* — Boyle Fredrickson, S.C.

(57) ABSTRACT

A frame that is fitted around the border of a display device such as, but not limited to, a television set is disclosed. The frame is configured to be removably mounted to the display device. According to one embodiment of the invention, the frame has multi-piece construction which provides for advertising panels to be removably inserted into the frame. The frame and the advertising panels may be constructed of a material which allows transmission of infrared and/or RF signals to pass through. Optionally, the frame and/or the advertising panels may include knock-out panels positioned over a receiver for an infrared and/or RF signal. A mounting system, such as a hook-and-loop fastening system, may be used to mount the frame to the display device.

19 Claims, 28 Drawing Sheets

(56) References Cited

U.S. PATENT DOCUMENTS

| | | | | |
|---|---|---|---|---|
| 5,549,267 | A | 8/1996 | Armbruster et al. | |
| 5,564,209 | A | 10/1996 | Zagnoli | |
| 5,638,096 | A | 6/1997 | Schwartz | |
| 5,889,623 | A | 3/1999 | Ueda et al. | |
| 6,006,414 | A | 12/1999 | Corporon et al. | |
| 6,010,338 | A * | 1/2000 | Watson | 434/81 |
| 6,067,738 | A * | 5/2000 | Zeligson | 40/606.03 |
| 6,209,248 | B1 | 4/2001 | Reinhard | |
| 6,266,069 | B1 | 7/2001 | Thagard et al. | |
| 6,347,469 | B1 * | 2/2002 | Huellinghoff et al. | 40/600 |
| 6,412,744 | B1 | 7/2002 | Wollam et al. | |
| 6,447,079 | B1 | 9/2002 | Irwin | |
| 6,478,282 | B1 | 11/2002 | Flemming | |
| 6,543,167 | B1 | 4/2003 | Dwyer | |
| 6,550,172 | B2 | 4/2003 | Korpai | |
| 6,686,900 | B1 | 2/2004 | Levy et al. | |
| 6,688,029 | B1 * | 2/2004 | Dunn | 40/711 |
| 6,745,508 | B1 * | 6/2004 | Ngan | 40/642.02 |
| 6,817,128 | B2 | 11/2004 | Korpai | |
| 6,826,859 | B1 | 12/2004 | Lin | |
| 6,826,863 | B1 | 12/2004 | Goodfellow | |
| D500,601 | S | 1/2005 | Shehu | |
| 6,854,941 | B2 | 2/2005 | Csik | |
| 6,868,630 | B2 | 3/2005 | Kim | |
| 6,977,694 | B2 | 12/2005 | Natsuyama | |
| 7,175,242 | B2 | 2/2007 | Lee et al. | |
| 7,194,828 | B2 * | 3/2007 | Peterson et al. | 40/1.5 |
| 7,219,460 | B1 | 5/2007 | Grayson | |
| 7,287,737 | B2 | 10/2007 | Rossi | |
| 7,301,589 | B2 | 11/2007 | Liao et al. | |
| 7,369,189 | B2 | 5/2008 | Chieh | |
| 7,681,350 | B2 | 3/2010 | Tsai et al. | |
| 7,690,143 | B2 * | 4/2010 | Kim et al. | 40/725 |
| 7,808,563 | B2 | 10/2010 | Sanchez | |
| 7,866,071 | B1 * | 1/2011 | Downey | 40/209 |
| 7,920,222 | B2 | 4/2011 | Chen et al. | |
| 7,940,518 | B2 | 5/2011 | Finnegan | |
| 8,045,068 | B2 | 10/2011 | Kim et al. | |
| 8,081,267 | B2 | 12/2011 | Moscovitch et al. | |
| 8,134,651 | B1 | 3/2012 | Reid | |
| 8,237,875 | B2 | 8/2012 | Nguyen | |
| 8,284,548 | B2 | 10/2012 | Takechi | |
| 8,297,001 | B2 | 10/2012 | Nakamura et al. | |
| 8,416,350 | B2 | 4/2013 | Tsanev et al. | |
| 8,484,873 | B2 * | 7/2013 | Splittgerber | 40/781 |
| 8,495,830 | B2 | 7/2013 | Price | |
| 2001/0037593 | A1 | 11/2001 | Korpai | |
| 2004/0150943 | A1 * | 8/2004 | Rock | 361/681 |
| 2004/0205582 | A1 | 10/2004 | Schiller et al. | |
| 2004/0227048 | A1 | 11/2004 | Lom et al. | |
| 2006/0000135 | A1 | 1/2006 | Yoon | |
| 2006/0096143 | A1 * | 5/2006 | Egan | 40/760 |
| 2007/0094904 | A1 * | 5/2007 | Frank et al. | 40/594 |
| 2008/0047287 | A1 * | 2/2008 | Ruppert | 62/256 |
| 2008/0098629 | A1 * | 5/2008 | Graham et al. | 40/201 |
| 2008/0120701 | A1 | 5/2008 | Schiller et al. | |
| 2008/0129646 | A1 | 6/2008 | Bhavnani | |
| 2008/0309833 | A1 | 12/2008 | Nakamura et al. | |
| 2009/0322982 | A1 | 12/2009 | Finnegan | |
| 2012/0091902 | A1 | 4/2012 | Radermacher | |
| 2013/0176510 | A1 | 7/2013 | Kawasaki et al. | |
| 2014/0047746 | A1 | 2/2014 | Errair | |

* cited by examiner

| TABLE 1 | |
|---|---|
| Part # | Description |
| 100 | television 100 |
| 100c | computer display 100c |
| 120 | television screen 120 |
| 140 | border 140 |
| 145 | fasteners 145 |
| 150 | border surface 150 |
| 160 | frame 160 |
| 180 | front surface 180 of frame 160 |
| 200 | rear surface 200 of frame 160 |
| 220 | images and/or text 220 |
| 300 | first longitudinal section 300 |
| 300x | longitudinal axis 300x |
| 320 | second longitudinal section 320 |
| 320x | longitudinal axis 320x |
| 340 | first side section 340 |
| 340x | longitudinal axis 340x |
| 360 | second side section 360 |
| 360x | longitudinal axis 360x |
| 380a, 380b | first and second opposite ends 380a and 380b of first longitudinal section 300 |
| 400a, 400b | front and rear sides 400a and 400b of first longitudinal section 300 |
| 420a, 420b | first and second longitudinal edges 420a and 420b of first longitudinal section 300 |
| 440a, 440b | first and second side walls 440a and 440b of first longitudinal section 300 |
| 460 | width 460 of rear side 400b |
| 500a, 500b | first and second opposite ends 500a and 500b of second longitudinal section 320 |
| 520a, 520b | front and rear sides 520a and 520b of second longitudinal section 320 |

FIG. 12A

| TABLE 1 (continued) | |
|---|---|
| Part # | Description |
| 540a, 540b | first and second longitudinal edges 540a and 540b of second longitudinal section 320 |
| 560a, 560b | first and second side walls 560a and 560b of second longitudinal section 320 |
| 580 | width 580 of rear side 520b |
| 600a, 600b | first and second opposite ends 600a and 600b of first side section 340 |
| 620a, 620b | front and rear sides 620a and 620b of first side section 340 |
| 640a, 640b | first and second longitudinal edges 640a and 640b of first side section 340 |
| 660a, 660b | first and second side walls 660a and 660b of first side section 340 |
| 680 | width 680 of the rear side 620b |
| 700a, 700b | first and second opposite ends 700a and 700b of second side section 360 |
| 720a, 720b | front and rear sides 720a and 720b of second side section 360 |
| 740a, 740b | first and second longitudinal edges 740a and 740b of second side section 360 |
| 760a, 760b | first and second side walls 760a and 760b of second side section 360 |
| 780 | width 780 of rear side 720b |
| 800a, 800b | first and second male tongues 800a and 800b of first longitudinal section 300 |
| 820a, 820b | first and second male tongues 820a and 820b of second longitudinal section 320 |
| 840a, 840b | first and second female slots 840a, 840b of first side section 340 |
| 860a, 860b | first and second female slots 860a, 860b of second side section 360 |

FIG. 12B

METHOD AND APPARATUS OF MOUNTING ADVERTISING TO A DISPLAY

CROSS-REFERENCE TO RELATED APPLICATIONS

This application is a continuation-in-part of U.S. patent application Ser. No. 14/109,500, filed on Dec. 17, 2013, which, in turn, is a continuation-in-part of U.S. patent application Ser. No. 13/904,335 filed on May 29, 2013, entitled Frame, which, in turn claims priority to U.S. provisional application Ser. No. 61/660,751, filed Jun. 17, 2012, and U.S. provisional application, Ser. No. 61/792,764, filed Mar. 15, 2013. The entire contents of each of these applications are incorporated herein by reference.

BACKGROUND OF THE INVENTION

The subject matter disclosed herein relates to a system of providing advertising around a video display and, more specifically, to a frame mountable to a video display in which advertisements may be removably inserted.

U.S. Pat. No. 6,266,069 describes a picture frame that can be used to exhibit regular objects such as photographs or other art works, as well as electronic images, including still and moving images. The frame includes a base, and a border forming a window through which a display area is visible. Electronic displays are attached to the base and/or the border, and a control circuit generates signals for the displays to display various images. The displays can be either color LCD devices or light emitting polymer devices. Imaging data for the displays is stored in an internal or replaceable memory.

U.S. Patent Publication 20090322982 describes a digital media apparatus, such as a digital frame, includes a LCD display having a front surface, electrical components that are connected to the LCD to provide images on the LCD, a glass border surrounding the LCD display, and a frame surrounding the LCD display and the glass border. A first portion of the glass border is opaque in order to conceal the electrical components. A second portion of the glass border is clear. The second portion of the glass border surrounds the first portion of the glass border to provide a visual effect of the LCD and second portion floating within the digital media apparatus.

Foreign Patent Number GB2475591 A describes an electronic picture frame comprises a main frame body, a liquid crystal display (LCD) screen and a circuit assembly. The LCD screen is mounted on the main frame body, and an auxiliary frame body equipped with a transparent plate is hinged with the main frame body. A picture accepting cavity is provided between the transparent plate and the auxiliary frame body. The circuit assembly is set in the main frame body or in the auxiliary frame body. A conventional paper photo can be contained in the auxiliary frame body, and a digital photo is displayed on the main frame body. Compared with the prior products, one photo frame of the present invention can simultaneously meet two requirements, so that practicability is greatly enhanced.

None of the above inventions and patents, taken either singly or in combination, is seen to describe the instant invention as claimed.

BRIEF DESCRIPTION OF THE INVENTION

The invention is directed to frames. More specifically, the invention is a frame that is fitted around the periphery border of a display device such as, but not limited to, a plasma display panel (PDP) such as a plasma television set, an organic light-emitting diode display (OLED), an active-matrix liquid crystal display (AMLCD), a digital light processing display (DLP), a surface-conduction electron-emitter display (SED), a light emitting diode (LED) display, a field emission display (FED), a quantum dot display (QLED), and an LCD (liquid crystal display). The frame is configured to be removably mounted to the display device. According to one embodiment of the invention, the frame is constructed, for example, of a foam material on which advertising is printed. According to another embodiment of the invention, the frame has multi piece construction which provides for advertising panels to be removably inserted into the frame. The frame and the advertising panels may be constructed of a material which allows transmission of infrared and/or RF signals to pass through. Optionally, the frame and/or the advertising panels may include knock-out panels positioned over a receiver for an infrared and/or RF signal.

In one non-limiting embodiment the frame is made of polystyrene, e.g., expanded polystyrene (EPS) foam. It should be understood that the term "polystyrene frame" is defined as a frame comprising expanded polystyrene (EPS) foam.

Compressible foam pads can be attached to the rear side of the frame to help prevent or reduce scratching between the rear of the frame and the periphery border of a display device, such as a television, to which the frame is attached.

A fastening means may be employed such as 3M™ Dual Lock™ re-closable fasteners or a hook-and-loop fastening system such as Velcro®.

In a further non-limiting embodiment the frame is made of polystyrene, and compressible foam pads having a sticky surface are used to secure the frame to a display without requiring a hook-and-loop fastening system.

In another non-limiting embodiment, a system for providing advertising around a periphery of a display includes a rear housing, a front housing, and an advertising panel. The rear housing includes a first planar surface, a first lip, and a first wall. The first planar surface has an outer periphery and an opening extending through the first planar surface. The opening defines an inner periphery corresponding to the periphery of the display. The first lip protrudes orthogonal to the first planar surface and has an inner surface and an outer surface. The first lip extends around the inner periphery of the first planar surface. The first wall protrudes orthogonal to the first planar surface and has an inner surface and an outer surface. The first wall extends around the outer periphery of the first planar surface. A width of the rear housing is defined by a distance between the inner surface of the first lip and the outer surface of the first wall. The front housing includes a second planar surface, a second lip, a second wall, and at least one shelf. The second planar surface has an outer periphery and an opening extending through the second planar surface. The opening defines an inner periphery corresponding to the periphery of the display. The second lip protrudes orthogonal to the second planar surface and has an inner surface and an outer surface. The second lip extends around the inner periphery of the second planar surface. The second wall protrudes orthogonal to the second planar surface and has an inner surface and an outer surface. The second wall extends around the outer periphery of the second planar surface. A width of the front housing is defined by a distance between the outer surface of the second lip and the inner surface of the second wall, and the width of the front housing is greater than the width of the rear housing. At least one shelf protrudes from either the second lip or the second wall proximate to the second planar surface. An advertising panel is configured to be retained at least in part between the at least one shelf and an inner surface of the second planar surface. The advertising panel is further retained between the front housing and the rear housing of the system. The front housing may be made of an optical grade clear polymer.

According to another aspect of the invention, the system may include a hook and loop fastener system. Either the hook portion or the loop portion is mounted to an inner surface of the rear housing and the other portion is mounted to the periphery of the display. The system may also include a fastener configured to positively retain the front housing to the rear housing. The fastener may be configured to pass through an opening extending through the first wall of the rear housing and an opening extending through the second wall of the front housing. The fastener may include a clip and a pin. The clip has a first side, a second side, and a base connecting the first side and the second side. Each of the first side and the second side includes an opening, and the clip is configured to be slid on the first wall such that the openings of the first wall of the rear housing, the second wall of the front housing, the first side of the clip, and the second side of the clip are aligned. The pin is insertable into the openings of the first wall of the rear housing, the second wall of the front housing, the first side of the clip, and the second side of the clip to positively retain the front housing to the rear housing. Optionally, at least one of the openings of the first wall of the rear housing, the second wall of the front housing, the first side of the clip, and the second side of the clip is threaded and the pin includes a threaded member to be rotatably inserted into the threaded opening.

According to another embodiment of the invention, a frame, for providing advertising around a periphery of a video display is disclosed. The frame includes a rear housing and a front housing. The rear housing has a first planar surface and a first wall. The first planar surface has an outer periphery and an opening extending through the first planar surface. The opening defines an inner periphery corresponding to the periphery of the display. The first wall protrudes orthogonal to the first planar surface and has an inner surface and an outer surface. The first wall extends around the outer periphery of the first planar surface. The front housing includes a second planar surface, a lip, a second wall, and at least one shelf. The second planar surface has an outer periphery and an opening extending through the second planar surface. The opening defines an inner periphery corresponding to the periphery of the display. The lip protrudes orthogonal to the second planar surface and has an inner surface and an outer surface. The lip extends around the inner periphery of the second planar surface. The second wall protrudes orthogonal to the second planar surface and has an inner surface and an outer surface. The second wall extends around the outer periphery of the second planar surface. The width of the front housing is greater than the width of the rear housing such that the first planar surface of the rear housing is received between the lip and the second wall. At least one shelf protrudes from one of the lip and the second wall proximate to the second planar surface, wherein the shelf is configured to retain, at least in part, an advertising panel between the shelf and the second planar surface. The advertising panel may be made of a paper stock having a weight equal to or less than 100 lb. and may include an opening or a knockout panel corresponding to a receiver for a remote control for the display.

According to another aspect of the invention, the front housing may also include at least one tab protruding orthogonally from the second wall toward the inner periphery. The height of the second wall is greater than the height of the first wall and the first wall is configured to be received between the second planar surface and the tab. Optionally, an infrared boost device may be supplied to amplify a signal transmitted from a remote control unit to the display unit.

According to yet another embodiment of the invention, a system for displaying an advertisement around a periphery of a display includes a rear housing, a front housing, and a sheet material. The rear housing has an opening extending through the rear housing which corresponds to the periphery of the display. The front housing also has an opening through the front housing which corresponds to the periphery of the display, and the front housing is configured to be selectively mounted to and removed from the rear housing. The sheet material is magnetically mounted to the rear housing, and the advertisement is printed on the sheet material and visible through the front housing when the front housing is mounted to the rear housing.

According to other aspects of the invention, the sheet material may be magnetic, the rear housing may be magnetic receptive, and the sheet material may then be applied to a surface of the rear housing. Optionally, the sheet material is a first sheet material, and the system further includes a second sheet material mounted to a surface of the rear housing. Either the first sheet material or the second sheet material is magnetic and the other is magnetic receptive. The system may also include a first and/or a second mechanical coupling configured to retain the front housing to the rear housing. The first mechanical coupling is configured for tool less mounting and removal of the front housing with the rear housing. The second mechanical coupling is configured to require a tool for mounting and removal of the front housing with the rear housing.

According to still another embodiment of the invention, a system for displaying an advertisement around a periphery of a display includes a rear housing and a front housing. The rear housing has a first width and includes a first planar surface with an outer periphery and a first opening extending through the first planar surface. The first opening corresponds to the periphery of the display. The front housing has a second width and includes a second planar surface with an outer periphery and a second opening extending through the second planar surface. The second width is greater than the first width, and the second opening also corresponds to the periphery of the display. The front housing is configured to be selectively mounted to and removed from the rear housing, and a sheet material is mounted to the first planar surface, where the sheet material is either a magnetic or a magnetic receptive material.

According to yet another embodiment of the invention, a system for displaying an advertisement around a periphery of a display includes a rear housing and a front housing. The rear housing has a first width and includes a first planar surface with an outer periphery and a first opening extending through the first planar surface. The first opening corresponds to the periphery of the display, and the rear housing is made from a magnetic receptive material. The front housing has a second width and includes a second planar surface with an outer periphery and a second opening extending through the second planar surface. The second width is greater than the first width, the second opening corresponds to the periphery of the display, and the front housing is configured to be selectively mounted to and removed from the rear housing.

According to still another embodiment of the invention, a method for providing advertising around a video display is disclosed. A rear housing is mounted around a periphery of the video display. The rear housing includes a first planar surface having an outer periphery and an opening extending through the first planar surface defining an inner periphery. A front housing is mounted to the rear housing. The front housing includes a second planar surface having an outer periphery and an opening extending through the second planar surface defining an inner periphery. An advertising panel is inserted between the rear housing and the front housing. The front housing is an optically clear material such that the advertising panel is visible through the front housing, and the opening in the rear and front housings generally correspond to the video display such that the video display is visible through the openings.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWING(S)

Various exemplary embodiments of the subject matter disclosed herein are illustrated in the accompanying drawings in which like reference numerals represent like parts throughout, and in which:

FIG. 12A-12B illustrate a table (Table 1) that lists reference numbers and their associated descriptions for FIGS. 1-11B;

Figure 1:
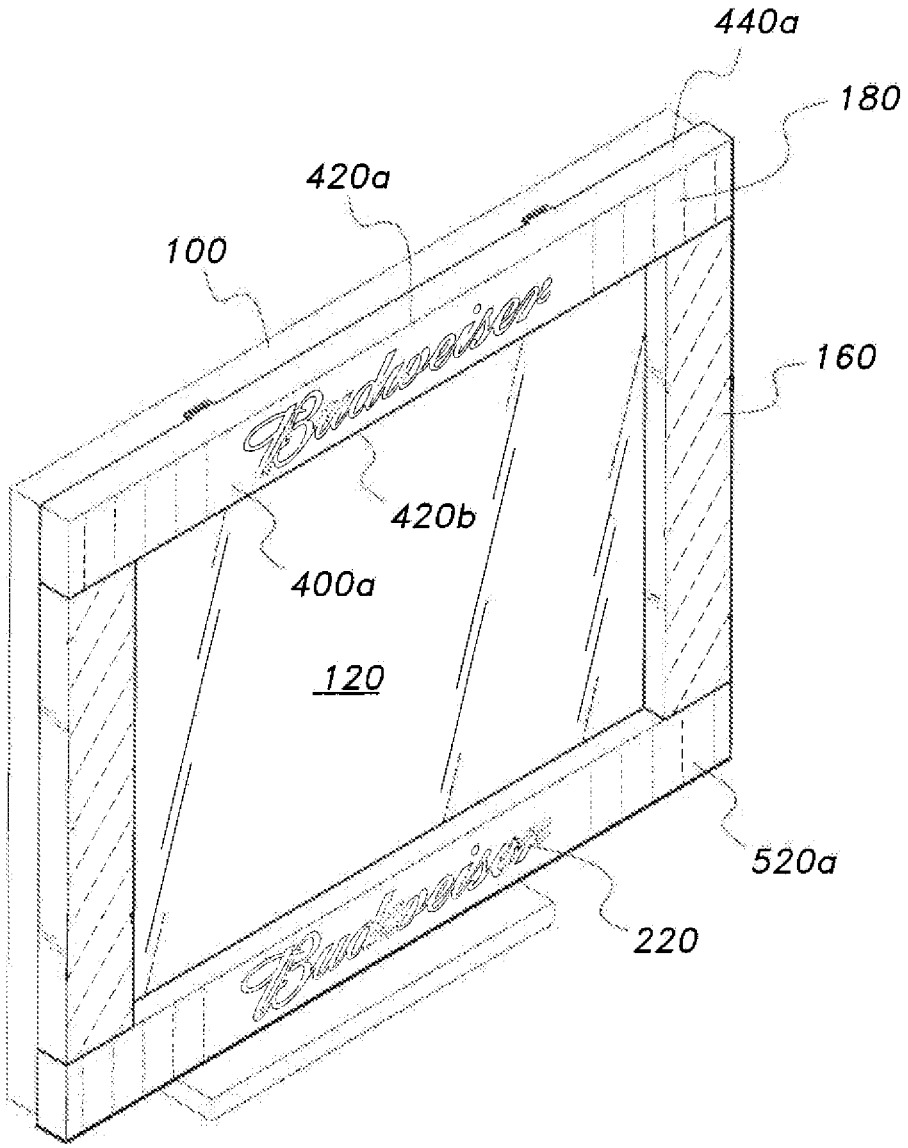
FIG. 1 is a perspective environmental view of a frame attached to the front part of a television according to one embodiment of the present invention.
Figure 2:
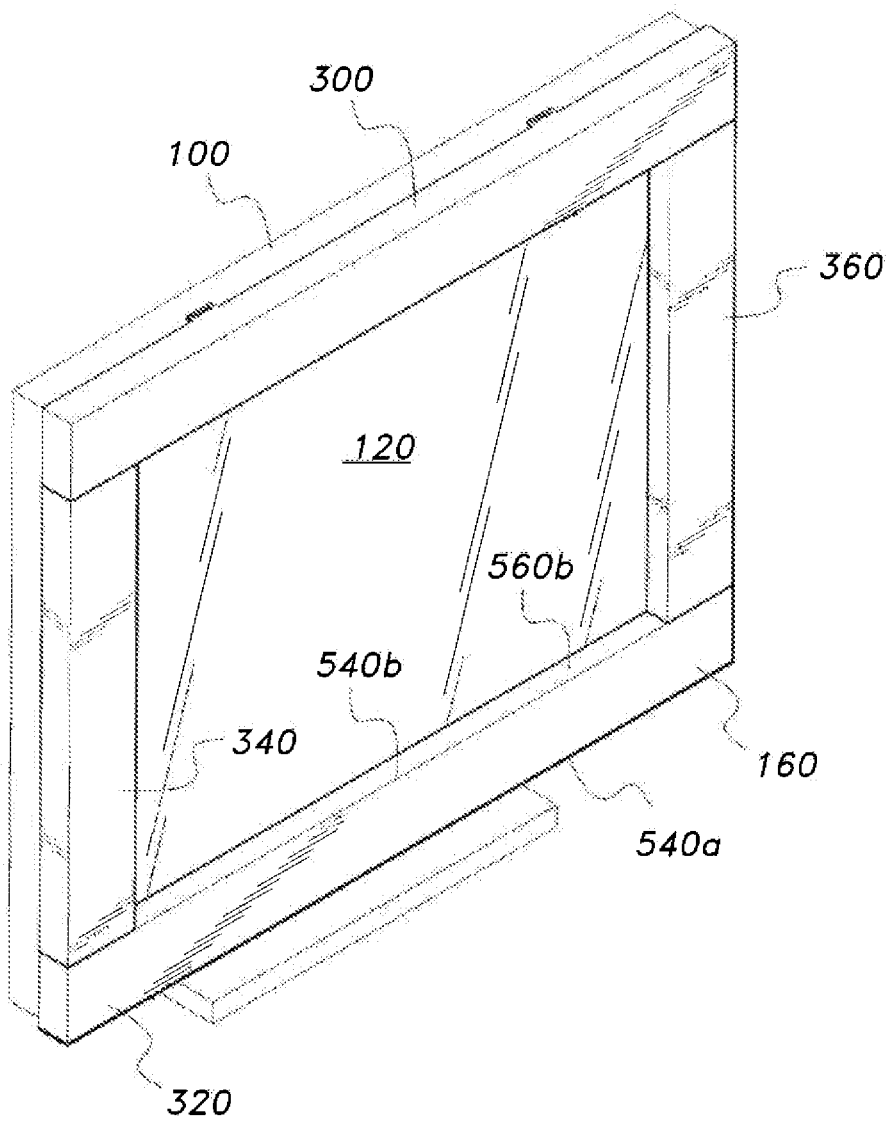
FIG. 2 is a further perspective environmental view of a frame attached to a television according to one embodiment of the present invention.
Figure 3:
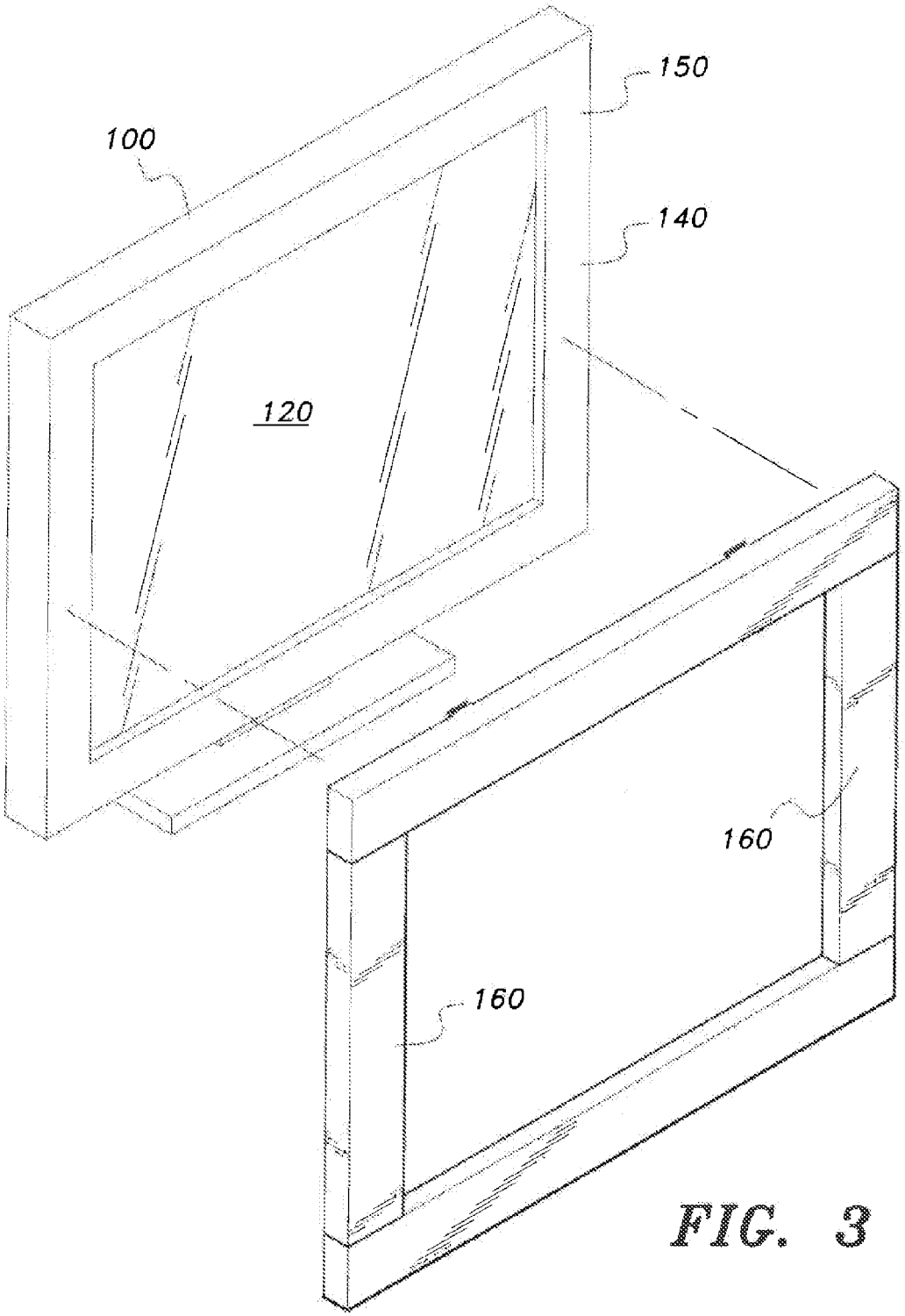
FIG. 3 is a further perspective environmental view of the frame of FIG. 2 about to be attached to the front border area of a television.
Figure 4:
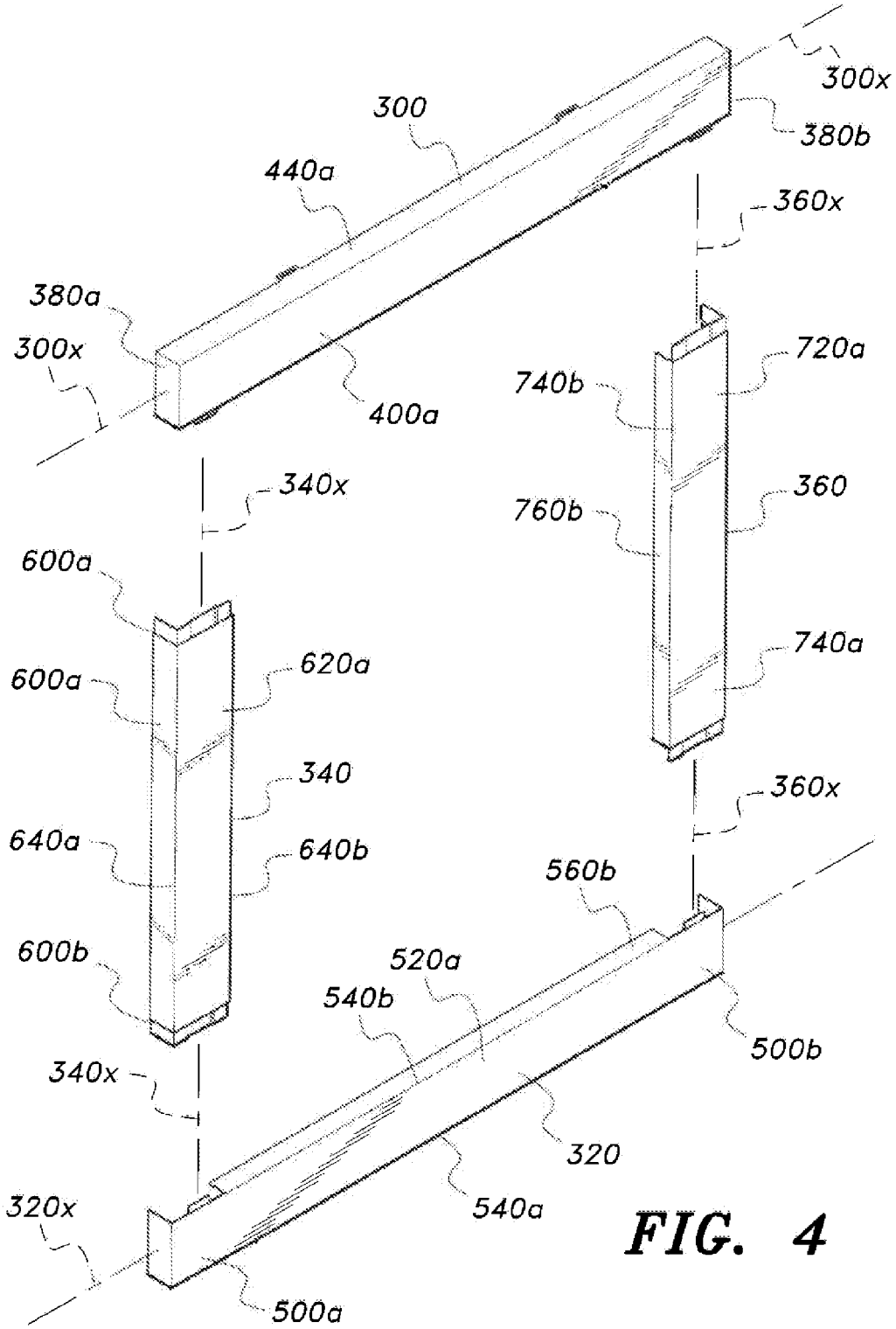
FIG. 4 is an exploded front view of a frame according to one embodiment of the present invention.
Figure 5:
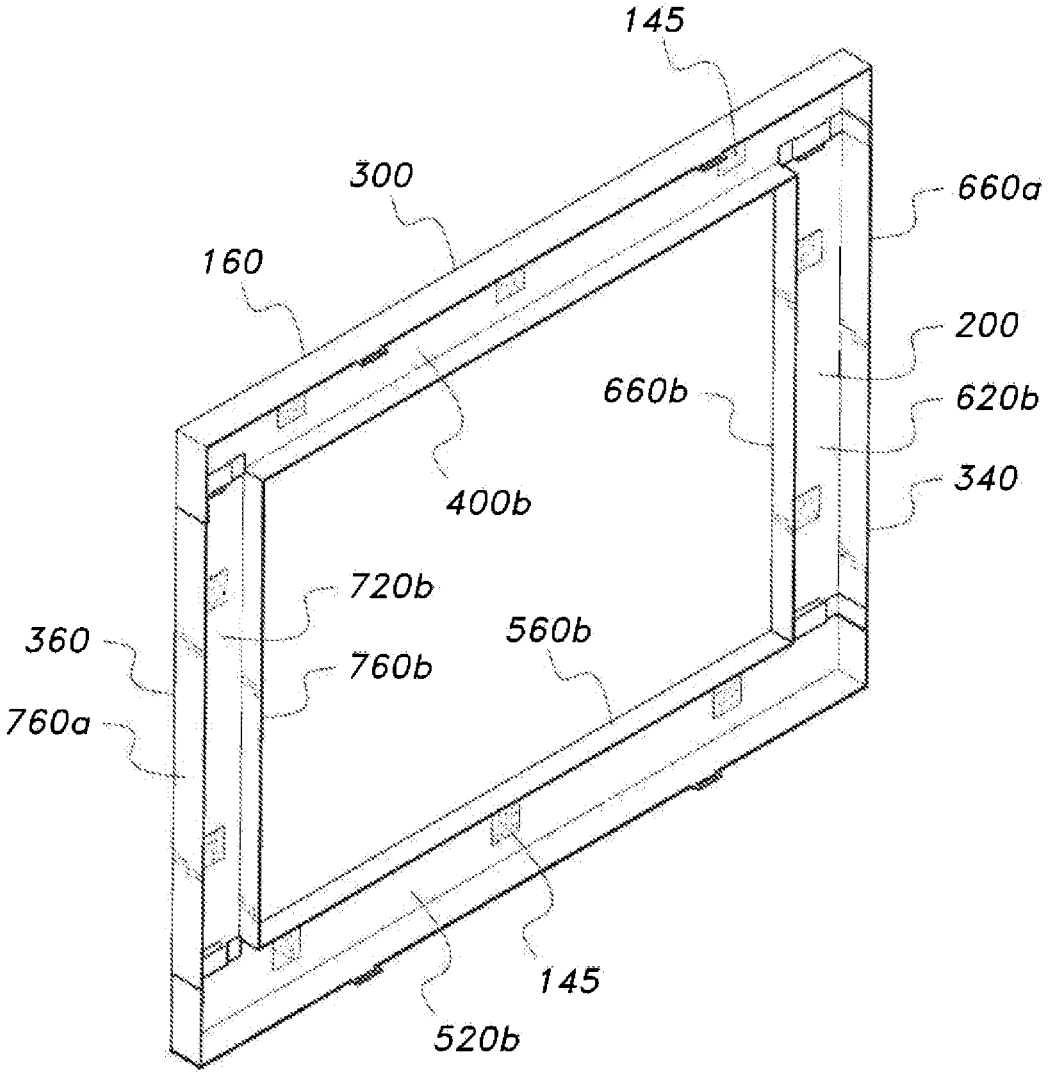
FIG. 5 is a rear view of the frame of FIG. 3.
Figure 6:
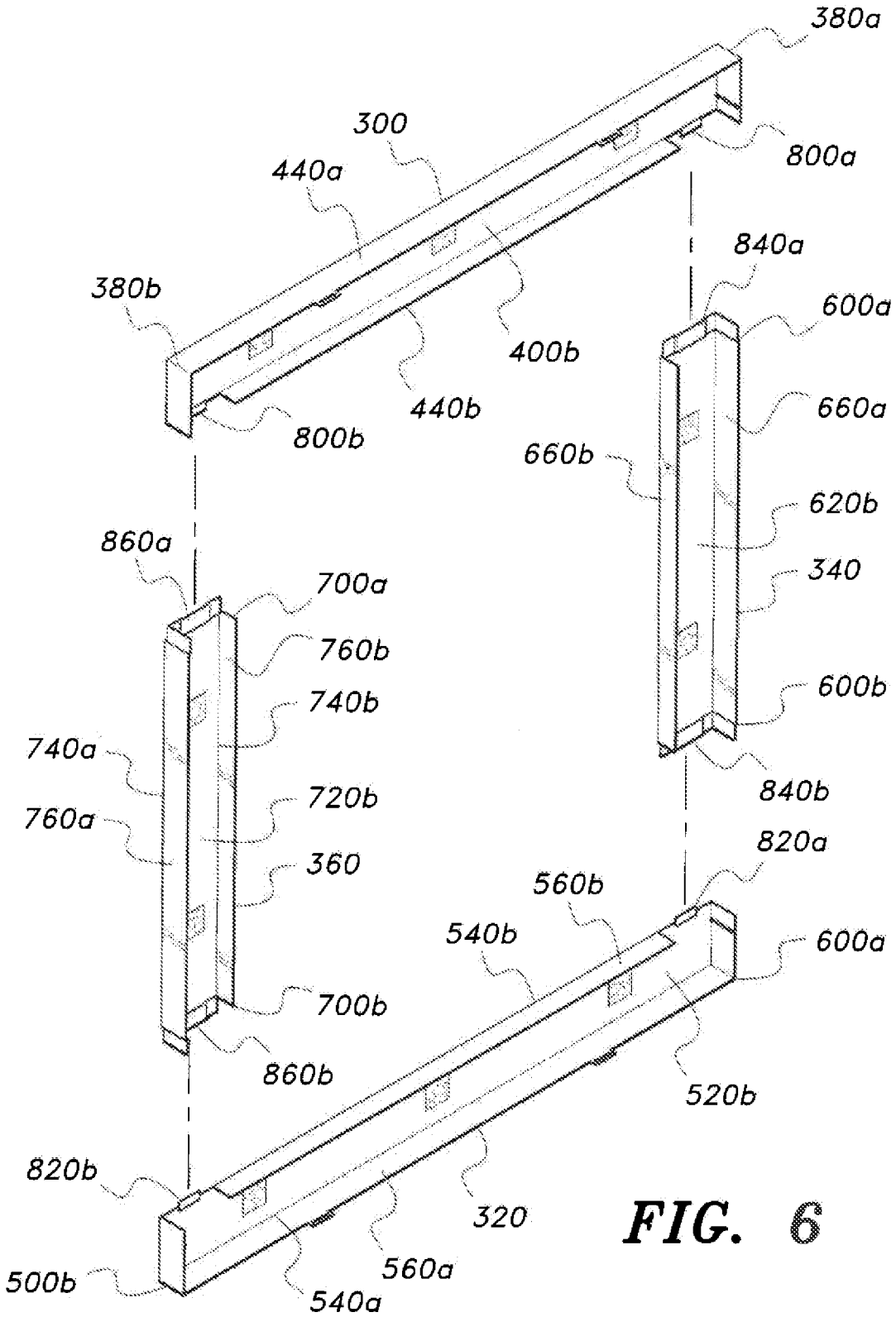
FIG. 6 is an exploded rear view of the frame of FIG. 5.

In describing the preferred embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENTS

The various features and advantageous details of the subject matter disclosed herein are explained more fully with reference to the non-limiting embodiments described in detail in the following description.

According to one embodiment of the invention, a frame is combined with a display device such as a television, computer display or other display system having a border area located around a display. The frame fits over at least part of the border and surrounds at least part of the screen. Display devices can take any form such as, but not limited to, television sets and computer screens.

Figure 7:
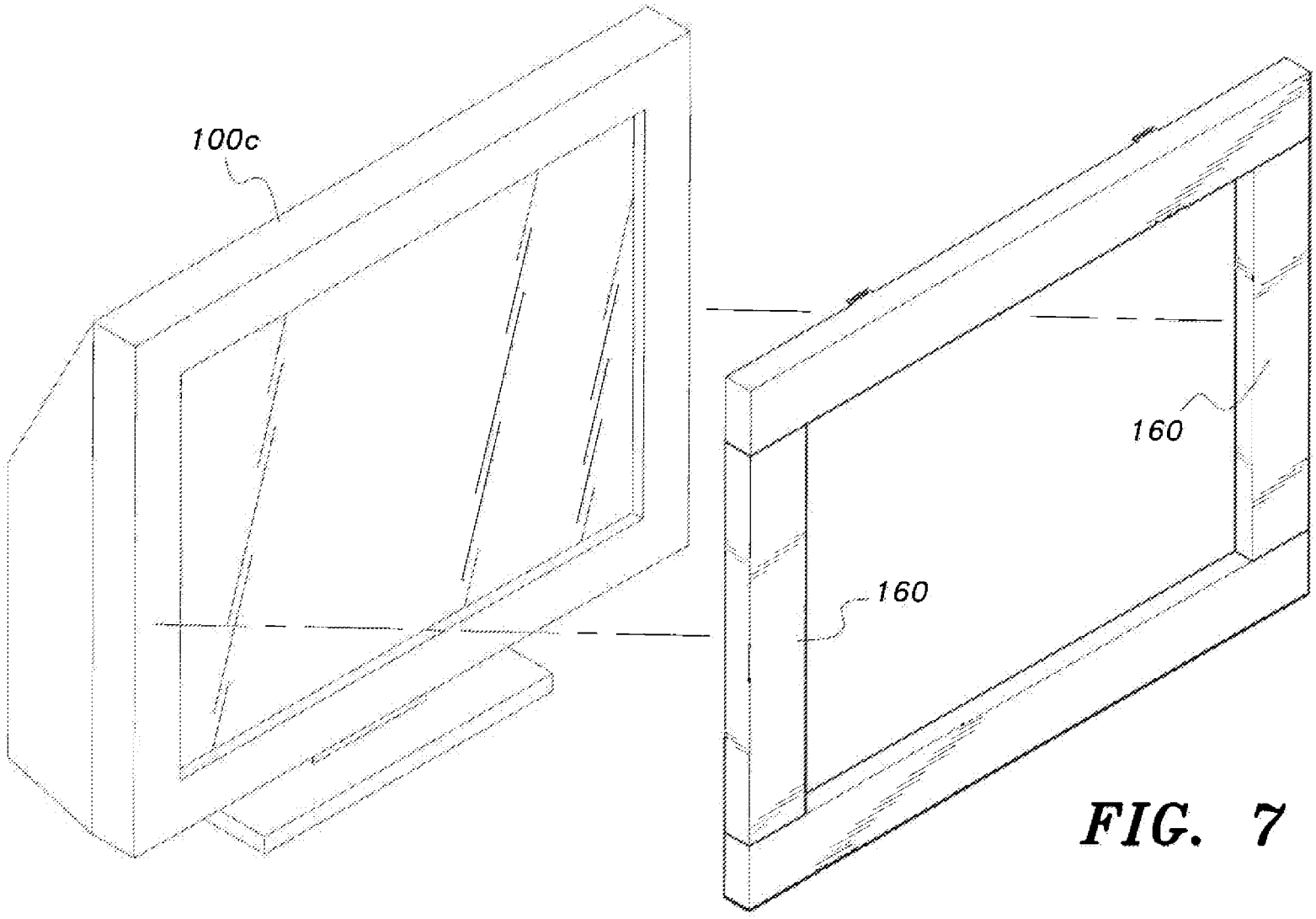
FIG. 7 is a further perspective environmental view of the frame of FIG. 2 about to be attached to the front border area of a computer display device.
Figure 8A:
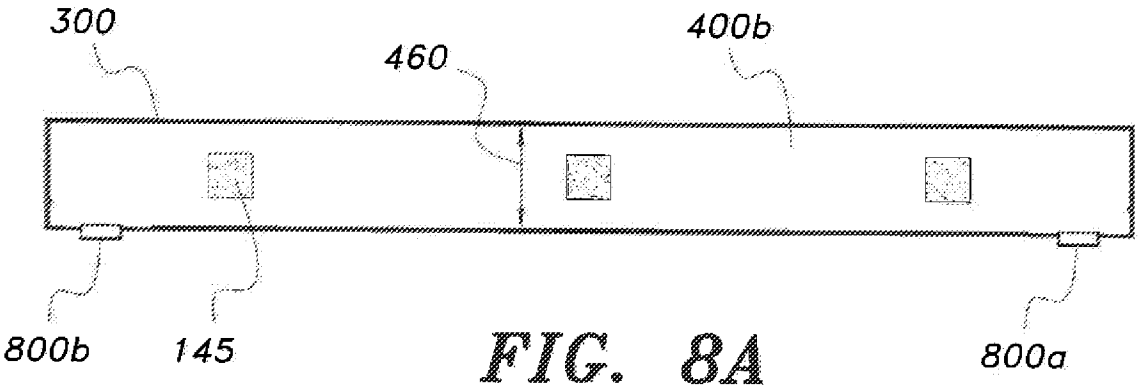
FIG. 8A is a rear elevation view of a first longitudinal section of the frame of FIG. 2.
Figure 8B:
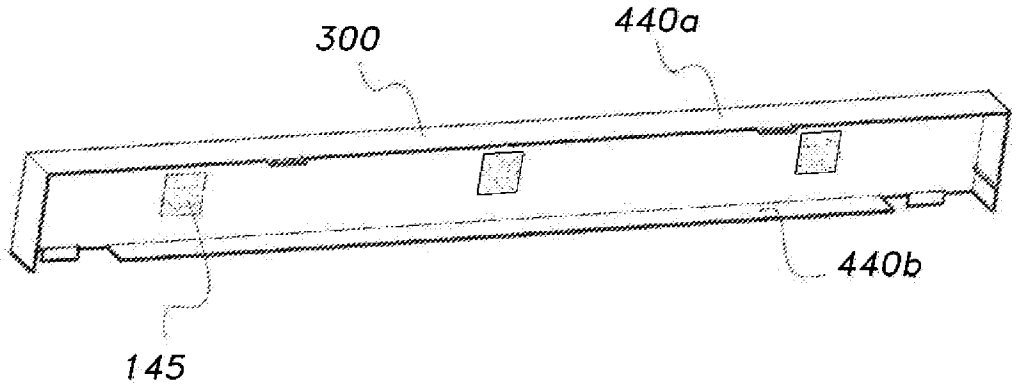
FIG. 8B is perspective view of the first longitudinal section of FIG. 8A.
Figure 9A:
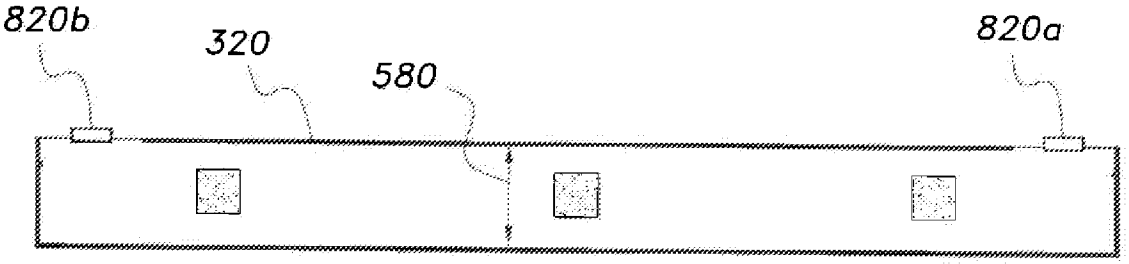
FIG. 9A is a rear elevation view a second longitudinal section of the frame of FIG. 2.
Figure 9B:
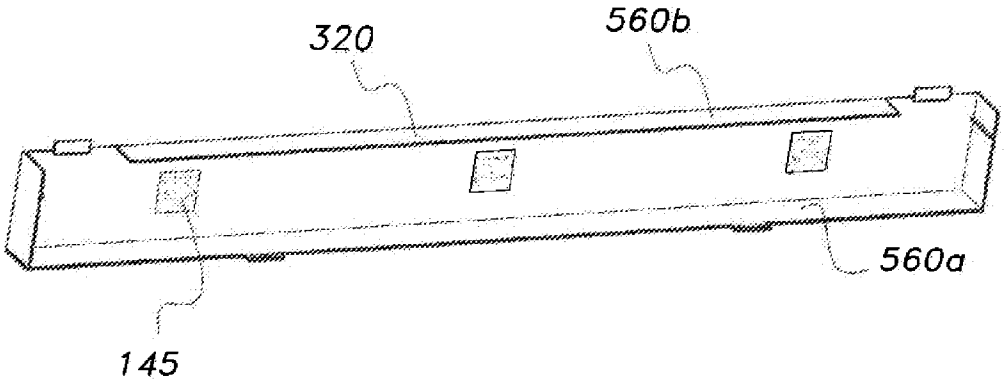
FIG. 9B is perspective view of the second longitudinal section of FIG. 9A.
Figure 10A:
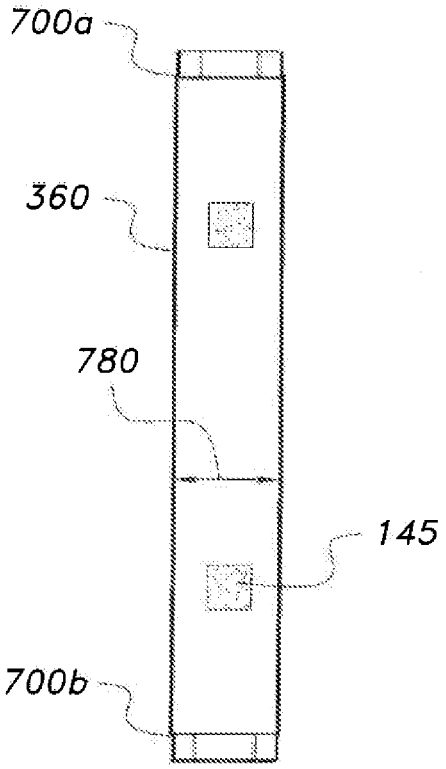
FIG. 10A is a rear elevation view of a second side section of the frame of FIG. 2.
Figure 10B:
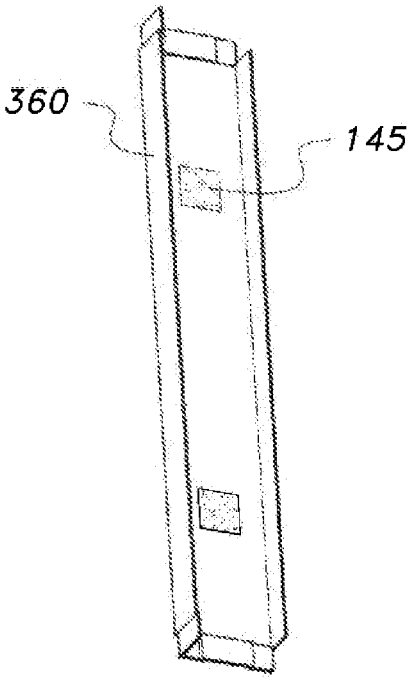
FIG. 10B is perspective view of the second side section of FIG. 10A.
Figure 11A:
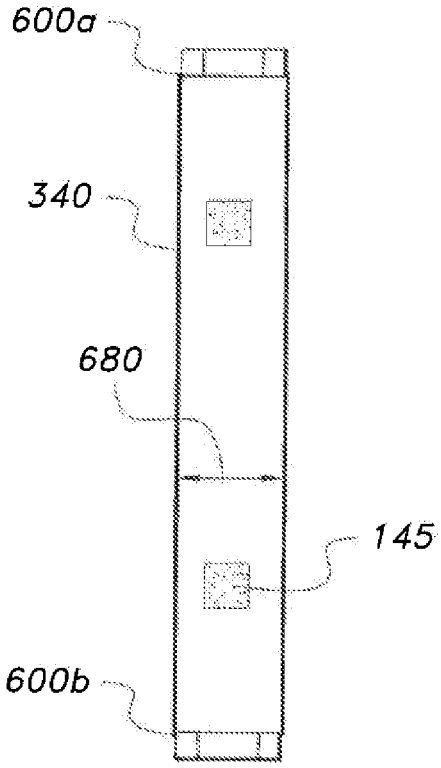
FIG. 11A is a rear elevation view of a first side section of the frame of FIG. 2.
Figure 11B:
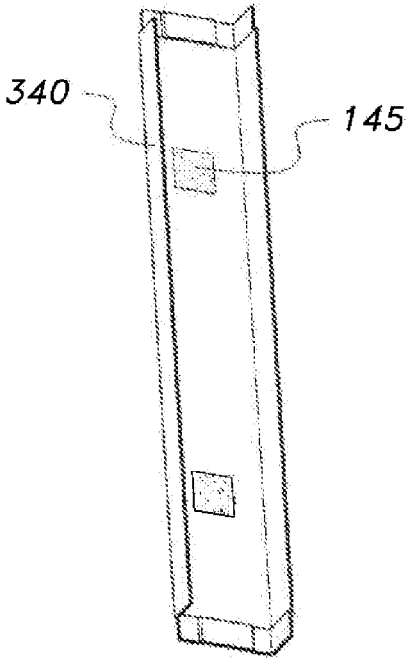
FIG. 11B is perspective view of the first side section of FIG. 11A.

The invention is illustrated using a television as an example of a display device. However, it should be understood that this is merely an exemplary display device; specifically, the frame of the invention can be applied to any display device having a border area located around a screen such as, but not limited to, a cathode based computer display device 100*c* shown in FIG. 7. The display device can be a flat screen computer display device based on, e.g., LCD or LED technology or any kind of display system.

A television 100 having a television screen 120 and a border 140. The border 140 is located around the television screen 120; the border 140 has an upper border surface 150. A frame 160 having a front surface 180 and a rear surface 200 is attached to at least a portion of the border 150 and preferably fits over the upper border surface 150 to surround at least a portion of the television screen 120.

Advertising material 220 can be printed or otherwise disposed on the front surface 180 of the frame 160. The front surface 180 enables advertising material to be visible around the television screen 120 without being printed directly to the border 140. Also, the frame can be easily replaced with a different frame with different images or indicia printed on the frame. The frame 160 can be attached to the border's upper surface 150 by any suitable attachment system such as, but not limited to, hook and loops attachment system (also known as "Velcro®") located between the frame and the border though 3M™ Dual Lock™ re-closable fastener attachment system is preferred.

The frame 160 can be made out of any suitable material such as synthetic material or natural material. For example, the frame 160 can be made of man made plastic; in a preferred embodiment the frame 160 is made of polystyrene, i.e., expanded polystyrene (EPS) foam. Examples of natural materials include wood.

Polystyrene has little mass and consequently requires minimal force or equipment to affix to the border surface 150. Thus, a frame 160 made out of polystyrene amounts to more than a mere design choice because should the frame 160 be attached to the border 150 of television display device located in, for example, a sports bar and should the frame 160 detach in whole or in part from the border surface 150 and fall onto patrons or staff in the sports bar there is very little chance of personal injury to anyone located below or near the television 100 while watching, for example, an American football match, baseball game, soccer game, tennis game, etc.

However, the frame 160 can be made out of any suitable plastic that offers durability and there is very little chance of personal injury should a plastic frame, in whole or in part, fall onto patrons in a sports bar and the like. For example, the frame 160 can be made of any suitable plastic material such, as but not limited to, thermoplastic materials including nylon; polyolefins such as polyethylene or polypropylene; polyesters such as polyethylene terephthalate; polystyrene, and polycarbonates.

The frame 160 can also be made out of transparent or translucent polymer such as that supplied by Chevron Phillips K-Resin® KR01 Styrene-Butadiene Copolymer. Other suitable polymers include polypropylene. The frame 160 can be made of polycarbonate polymer supplied under the Lexan® trade name.

The frame 160 can be attached to the border 140 by means of any suitable attachment system such as the 3M™ Dual Lock™ re-closable fasteners 145, e.g., 3M™ part numbers: SJ3540, SJ3550, SJ3551, and SJ3560. This type of attachment system employs a plurality of stems with mushroom like top ends that audibly "SNAP" together to form a secure attachment with strong adhesive backings that adhere to the border surface 150 and rear surface 200 of the frame 160.

In one embodiment of the invention the frame 160 comprises: a first longitudinal section 300, a second longitudinal section 320, a first side section 340 and a second side section 360. The first longitudinal section 300, second longitudinal section 320, first side section 340, and the second side section 360, respectively, define longitudinal axes: 300*x*, 320*x*, 340*x* and 360*x*.

The first longitudinal section 300 defines first and second opposite ends 380*a* and 380*b*, respectively; front and rear sides 400*a* and 400*b*, respectively; first and second longitudinal edges 420*a* and 420*b*, respectively; and first and second side walls 440*a* and 440*b*, respectively. The first and second longitudinal edges 420*a* and 420*b* run parallel to the longitudinal axis 300*x*. The first and second side walls 440*a* and 440*b* extend perpendicularly inward from the first and second longitudinal edges 420*a* and 420*b*, respectively. The first and second side walls 440*a* and 440*b* define the width 460 of the rear side 400*b*.

The second longitudinal section 320 defines first and second opposite ends 500*a* and 500*b*, respectively; front and rear sides 520*a* and 520*b*, respectively; first and second longitudinal edges 540*a* and 540*b*, respectively; and first and second side walls 560*a* and 560*b*, respectively. The first and second longitudinal edges 540*a* and 540*b* run parallel to the longitudinal axis 320*x*. The first and second side walls 560*a* and 560*b* extend perpendicularly inward from the first and second longitudinal edges 540*a* and 540*b*, respectively. The first and second side walls 560*a* and 560*b* define the width 580 of the rear side 520*b*.

The first side section 340 defines first and second opposite ends 600*a* and 600*b*, respectively; front and rear sides 620*a* and 620*b*, respectively; first and second longitudinal edges 640*a* and 640*b*, respectively; and first and second side walls 660*a* and 660*b*, respectively. The first and second longitudinal edges 640*a* and 640*b* run parallel to the longitudinal axis 340*x*. The first and second side walls 660*a* and 660*b* extend perpendicularly inward from the first and second longitudinal edges 640*a* and 640*b*, respectively. The first and second side walls 660*a* and 660*b* define the width 680 of the rear side 620*b*.

The second side section 360 defines first and second opposite ends 700*a* and 700*b*, respectively; front and rear sides 720*a* and 720*b*, respectively, first and second longitudinal edges 740*a* and 740*b*, respectively; and first and second side walls 760*a* and 760*b*, respectively. The first and second longitudinal edges 740*a* and 740*b* run parallel to the longitudinal axis 360*x*. The first and second side walls 760*a* and 760*b* extend perpendicularly inward from the first and second longitudinal edges 740*a* and 740*b*, respectively. The first and second side walls 760*a* and 760*b* define the width 780 of the rear side 720*b*.

The first and second opposite ends 380*a* and 380*b* of the first longitudinal section 300 respectively define first and second male tongues 800*a* and 800*b*. The male tongues 800*a* and 800*b* extend outwards at a perpendicular angle with respect to the longitudinal axis 300*x* of the first longitudinal section 300.

The first and second opposite ends 500*a* and 500*b* of the second longitudinal section 320 respectively define first and second male tongues 820*a* and 820*b*. The male tongues 820*a* and 820*b* extend outwards at a perpendicular angle with respect to the longitudinal axis 320*x* of the second longitudinal section 320.

The rear side 620*b* of each of the opposite ends 600*a* and 600*b* of the first, side section 340 respectively define first and second female slots 840*a* and 840*b*. The first and second female slots 840*a* and 840*b* respectively accommodate male tongues 800*a* and 820*a*.

The rear side 720*b* of each of the opposite ends 700*a* and 700*b* of the second side section 360 respectively define first and second female slots 860*a* and 860*b*. The first and second female slots 860*a* and 860*b* respectively accommodate male tongues 800*b* and 820*b*. It should be understood that the male tongues and female slots can be located in reverse. That is, tongues could extend from the opposite ends of the first and second side sections 340 and 360, and complementary slots fitted to the opposite ends of the first and second longitudinal sections 300 and 320.

Figure 13:
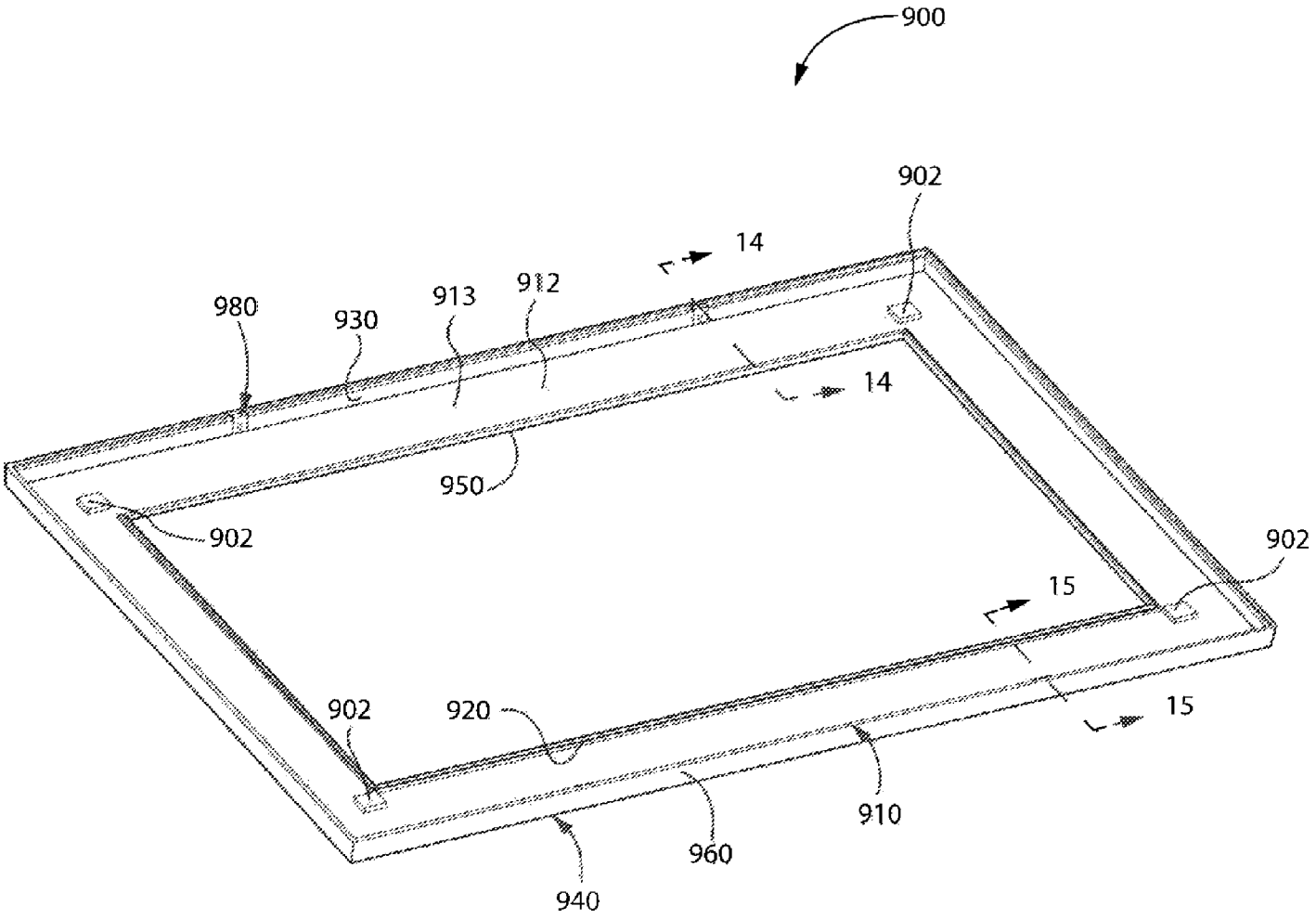
FIG. 13 is a perspective view of a frame according to another embodiment of the present invention.
Figure 15:
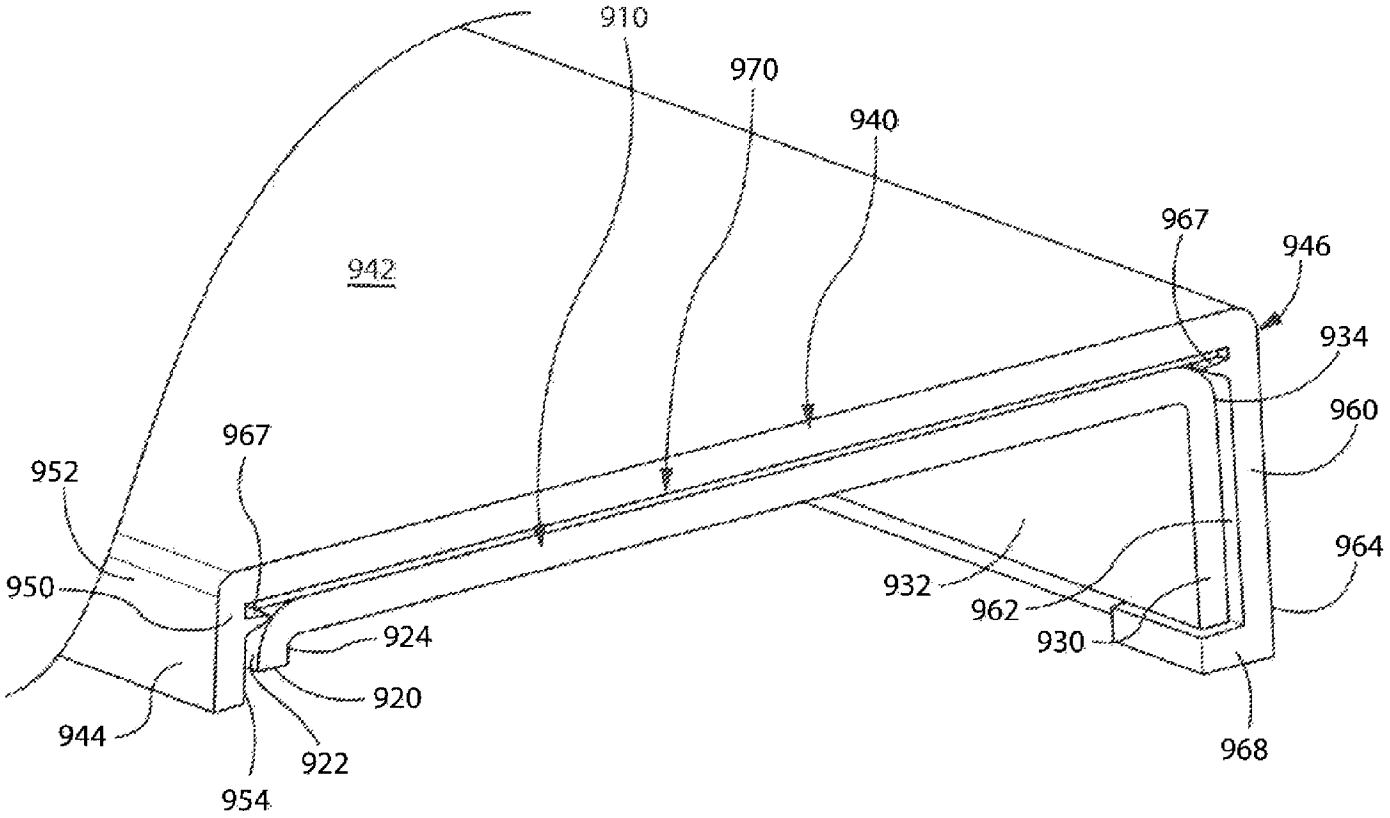
FIG. 15 is a sectional view of the frame of FIG. 13 at 15-15.
Figure 25:
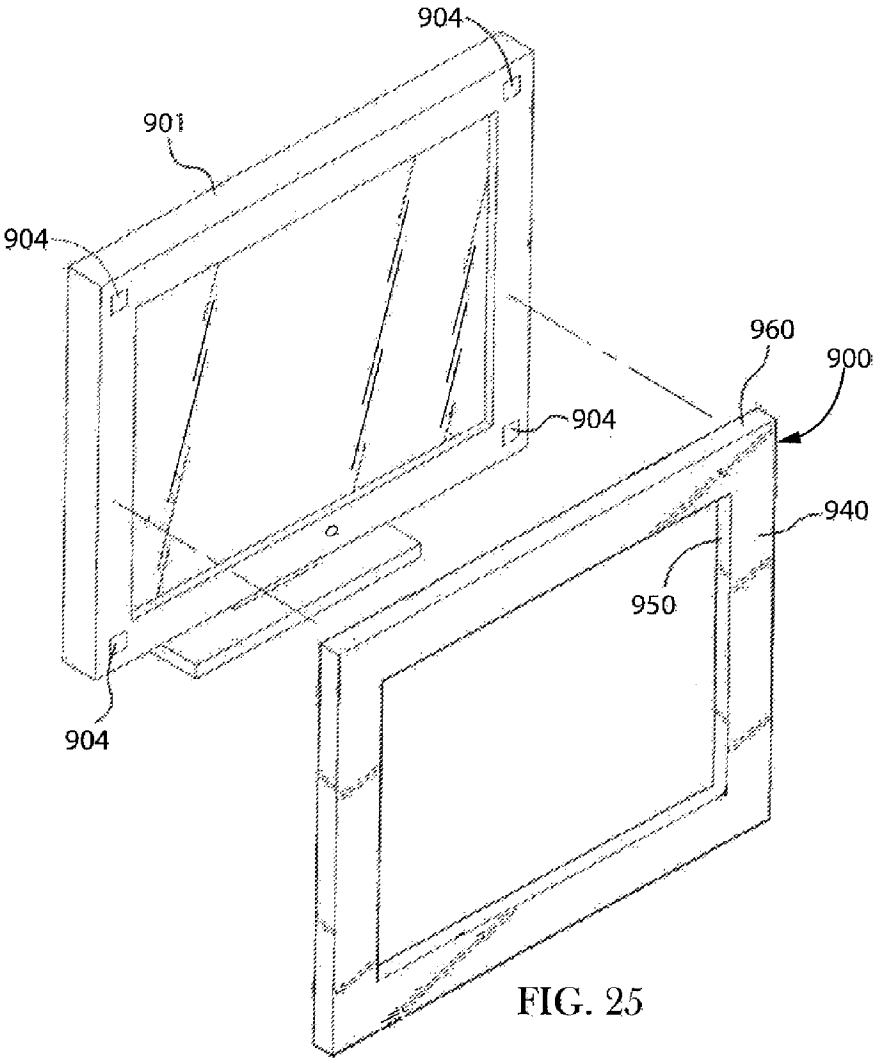
FIG. 25 is a further perspective environmental view of the frame of FIG. 13 about to be attached to a television.
Figure 26:
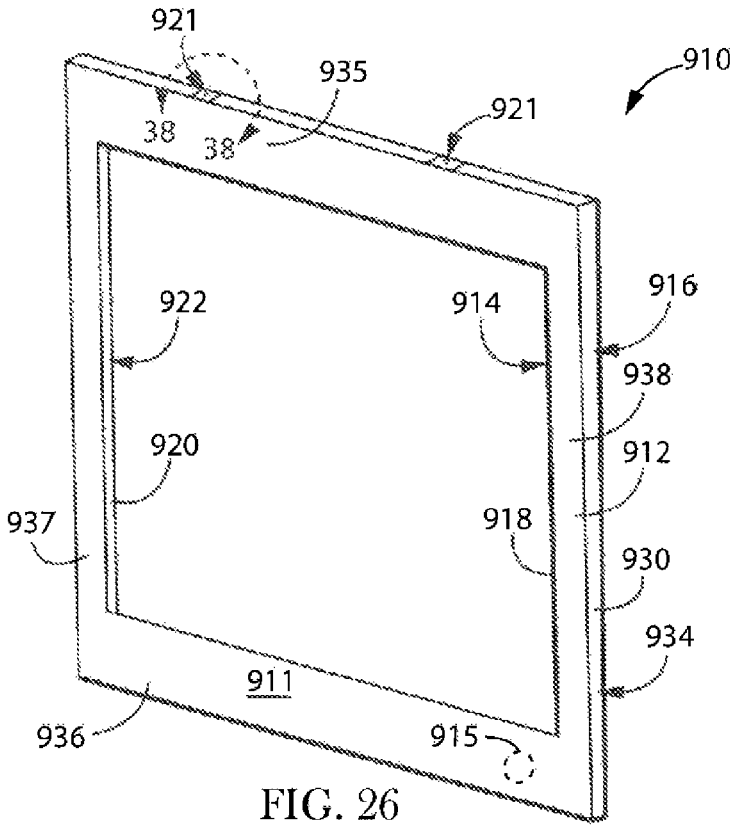
FIG. 26 is a perspective view of a rear housing for the frame according to another embodiment of the present invention.
Figure 27:
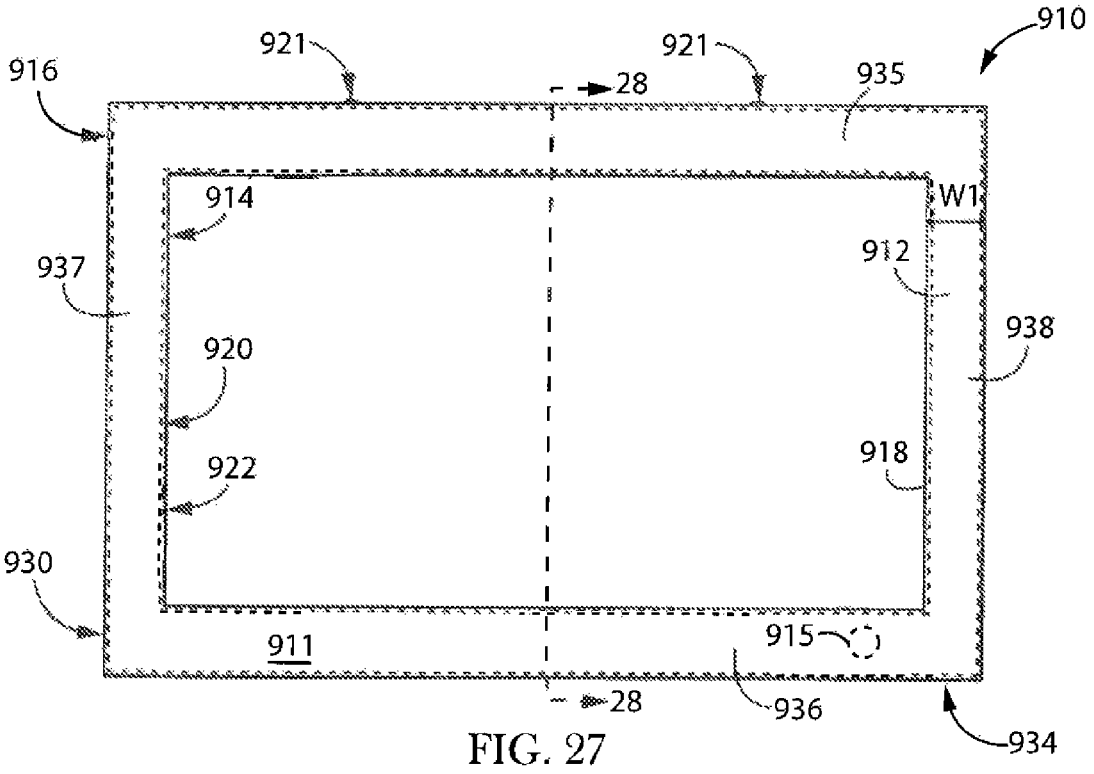
FIG. 27 is a front elevation view of the rear housing of FIG. 26.
Figure 28:
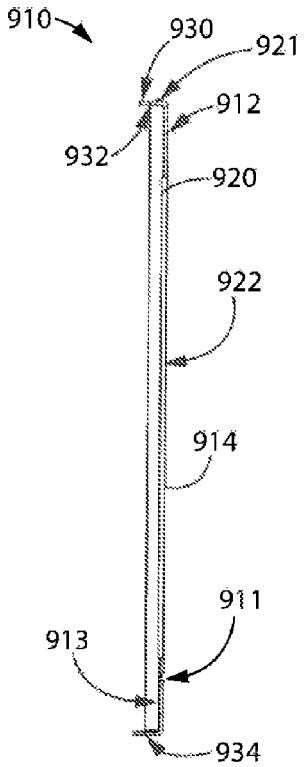
FIG. 28 is a sectional view of the rear housing of FIG. 27 taken at 28-28.
Figure 29:
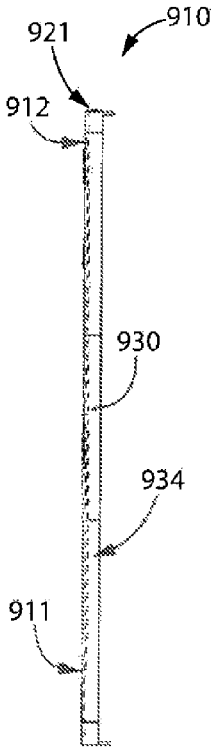
FIG. 29 is a side elevation view of the rear housing of FIG. 26.
Figure 30:
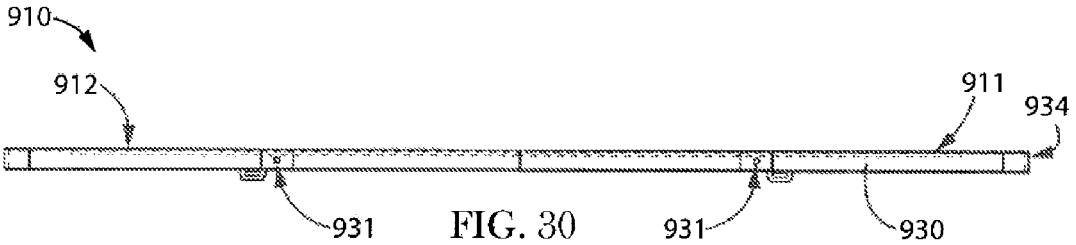
FIG. 30 is a bottom plan view of the rear housing of FIG. 26.
Figure 31:
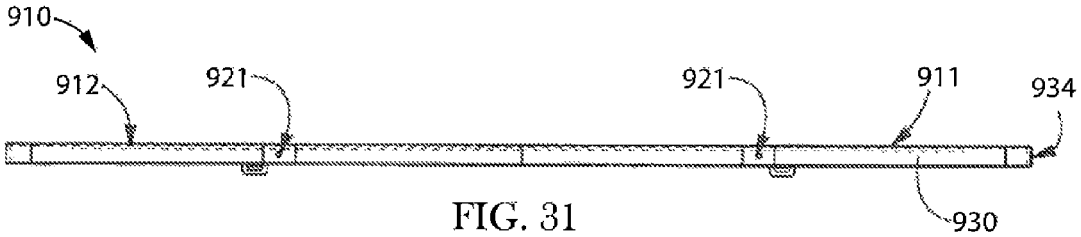
FIG. 31 is a top plan view of the rear housing of FIG. 26.
Figure 32:
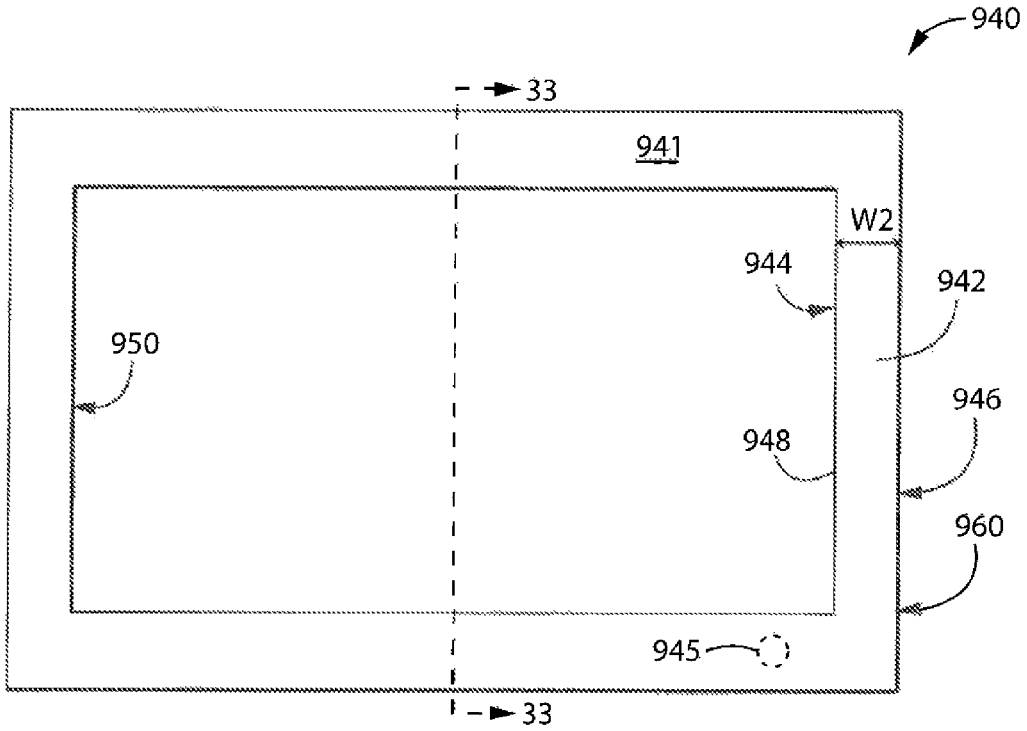
FIG. 32 is a front elevation view of a front housing for the frame according to the embodiment of the present invention illustrated in FIG. 26.
Figure 33:
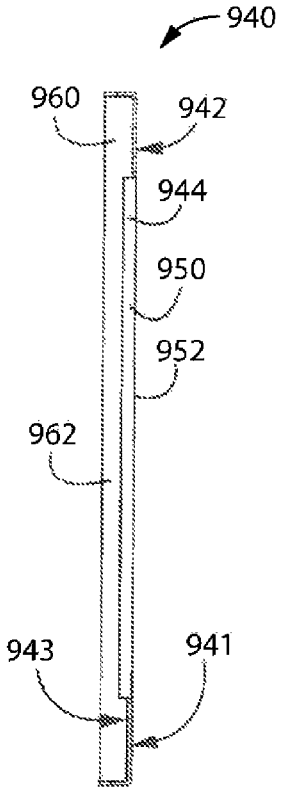
FIG. 33 is a sectional view of the front housing of FIG. 32 taken at 33-33.
Figure 34:
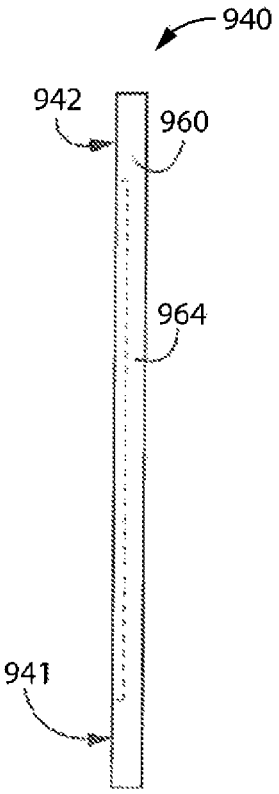
FIG. 34 is a side elevation view of the front housing of FIG. 32.
Figure 35:
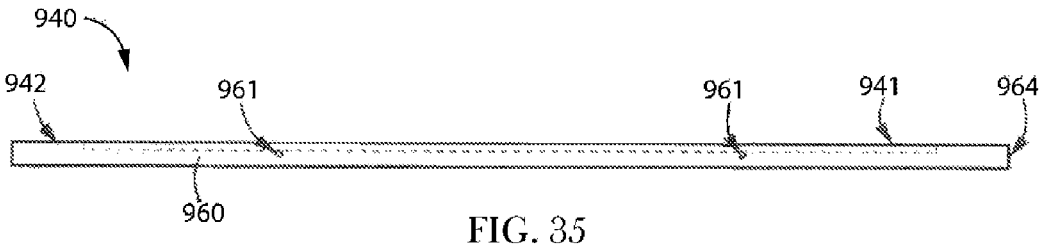
FIG. 35 is a bottom plan view of the front housing of FIG. 32.

Referring next to FIG. 13, a frame 900 according to another embodiment of the invention is illustrated. The frame 900 includes a rear housing 910 and a front housing 940 between which an advertising panel 970 may be inserted. Referring also to FIG. 15, the front housing 940 includes at least one shelf 967 configured to retain the advertising panel 970. A mounting system, such as hook and loop fasteners may be provided to mount the frame 900 to a display. With reference also to FIG. 25, one side of the hook and loop fastener 902 is mounted to the rear housing 910 and the other side of the hook and loop fastener 904 is mounted to a periphery of a display 901. The rear housing 910 is press fit to the display such that the two sides (902, 904) of the hook and loop fasteners engage and retain the frame 900 to the display 901. Optionally, the mounting system may be 3M™ Dual Lock™ re-closable fasteners which employs a plurality of stems with mushroom like top ends on both fastening portions that audibly "SNAP" together to form a secure attachment.

With reference to FIGS. 17-20, one embodiment of the rear housing 910 is illustrated. The rear housing 910 includes a planar surface 912 configured to fit around a video display. The planar surface 912 has an outer periphery 916 and an opening 918 which extends through the planar surface 912 defining an inner periphery 914 of the planar surface 912. It is contemplated that the opening 918 is sized such that the inner periphery 914 of the rear housing 910 corresponds to the periphery of the video display around which the frame 900 will be mounted. The planar surface 912 includes an inner surface 913 configured to face toward the video display and an outer surface 911 configured to face away from the video display.

According to the illustrated embodiment, the rear housing 910 includes a lip 920 protruding orthogonally from, and along the inner periphery 914 of; the planar surface 912. The lip 920 includes an inner surface 922 facing toward the opening 918 and an outer surface 924 facing toward the outer periphery 916 of the rear housing 910. The lip 920 provides rigidity to the rear housing 910 and may extend, for example, a distance equal to the thickness of one or both sides (902, 904) of the hook and loop fasteners. According to another embodiment of the invention, the inner periphery 914 of the planar surface 912 may terminate in an edge having a squared or curved surface without a lip 920 protruding from the planar surface 912.

The rear housing 910 also includes a wall 930 protruding orthogonally from, and along the outer periphery 916 of, the planar surface 912 in the same direction as the lip 920. The wall 930 includes an inner surface 932 facing toward the opening 918 and an outer surface 934 which is generally aligned with the outer periphery 916 of the rear housing 910. The wall 930 may extend, for example, a distance sufficient to overlap, at least in part, a side of the video display 901 to which the rear housing 910 is mounted. According to another embodiment of the invention, the wall 930 extends a distance no greater than the thickness of both sides (902, 904) of the hook and loop fasteners, allowing the hook and loop fasteners to engage each other yet providing a visual block so that the mounting system is not viewable from around the edge of the frame 900. The rear housing 910 has a width, W1, defined by the inner periphery 914 and the outer periphery 916 of the planar surface 912.

Figure 19:
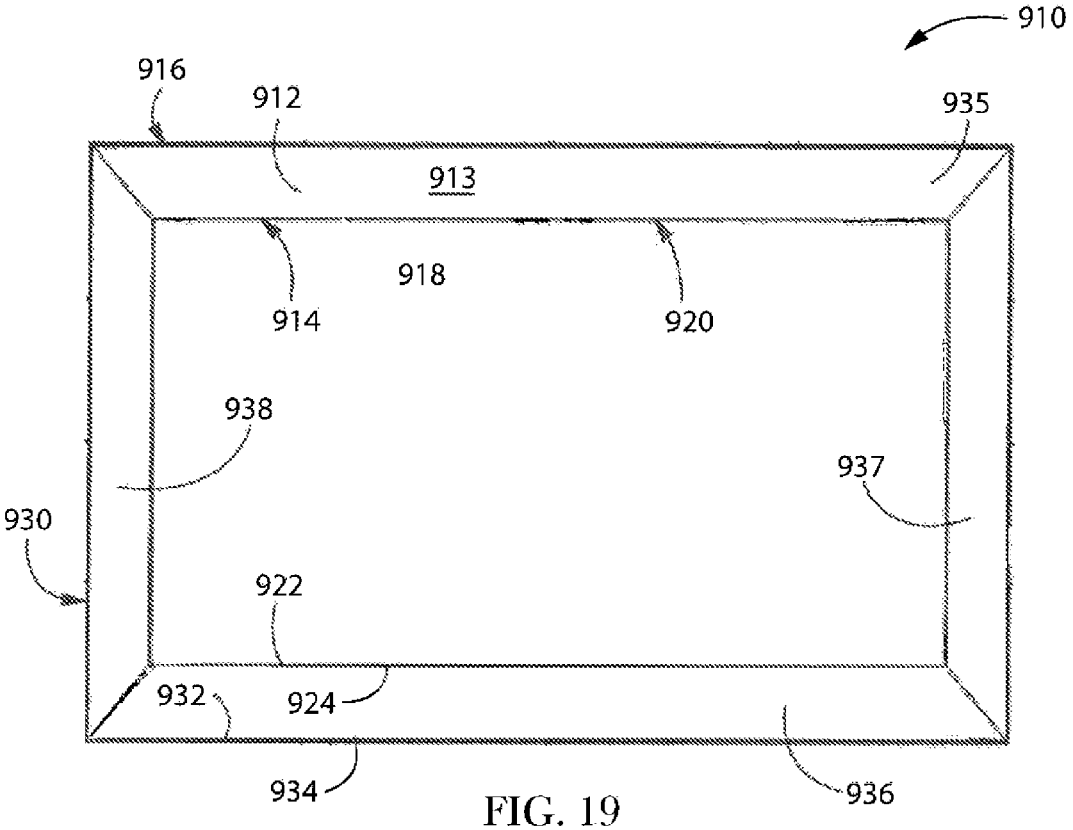
FIG. 19 is a rear elevation view of the rear housing according to another embodiment of the present invention.
Figure 20:
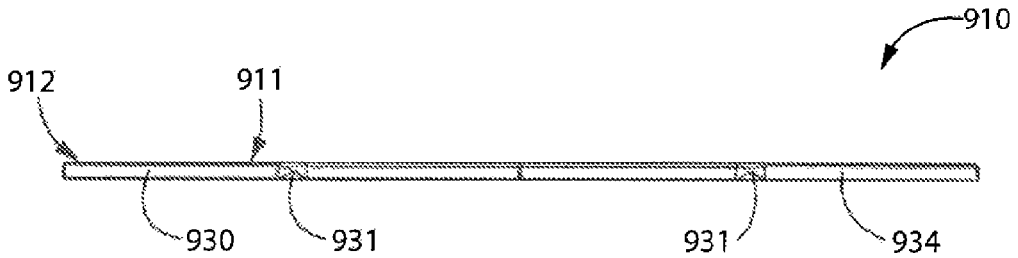
FIG. 20 is a bottom plan view of the rear housing for the frame of FIG. 13.
Figure 21:
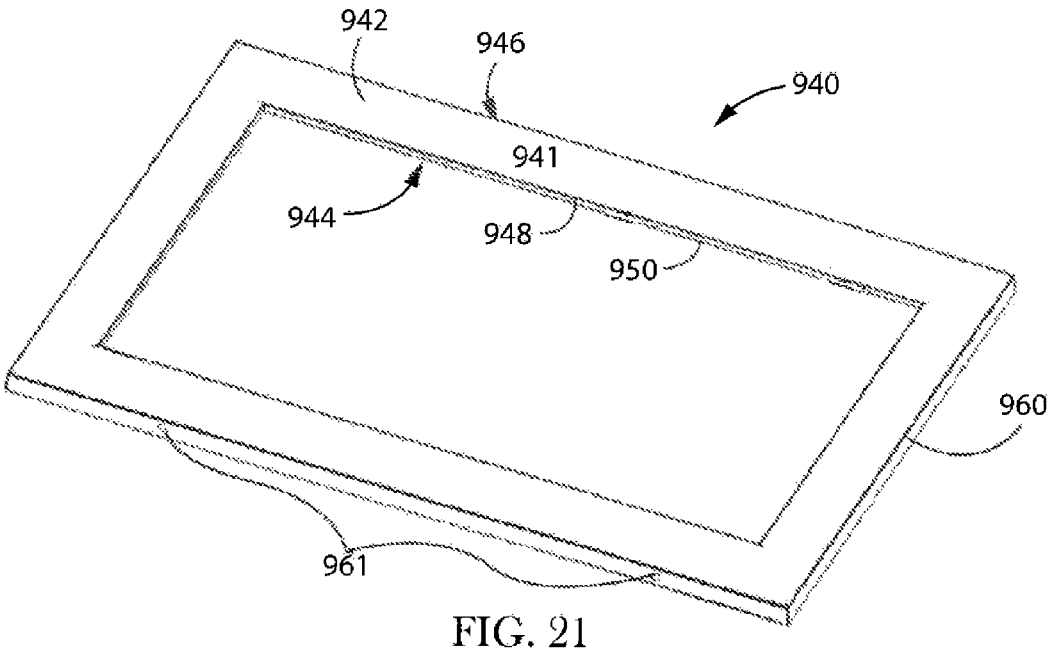
FIG. 21 is a perspective view of a front housing for the frame of FIG. 13.
Figure 22:
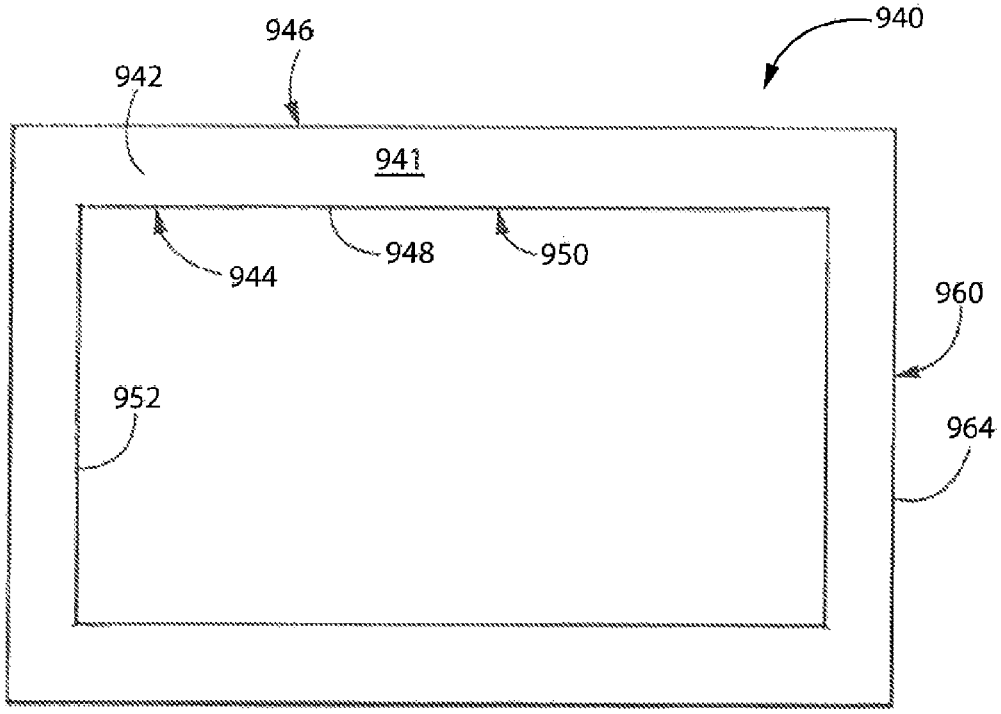
FIG. 22 is a front elevation view of the front housing for the frame of FIG. 13.
Figure 23:
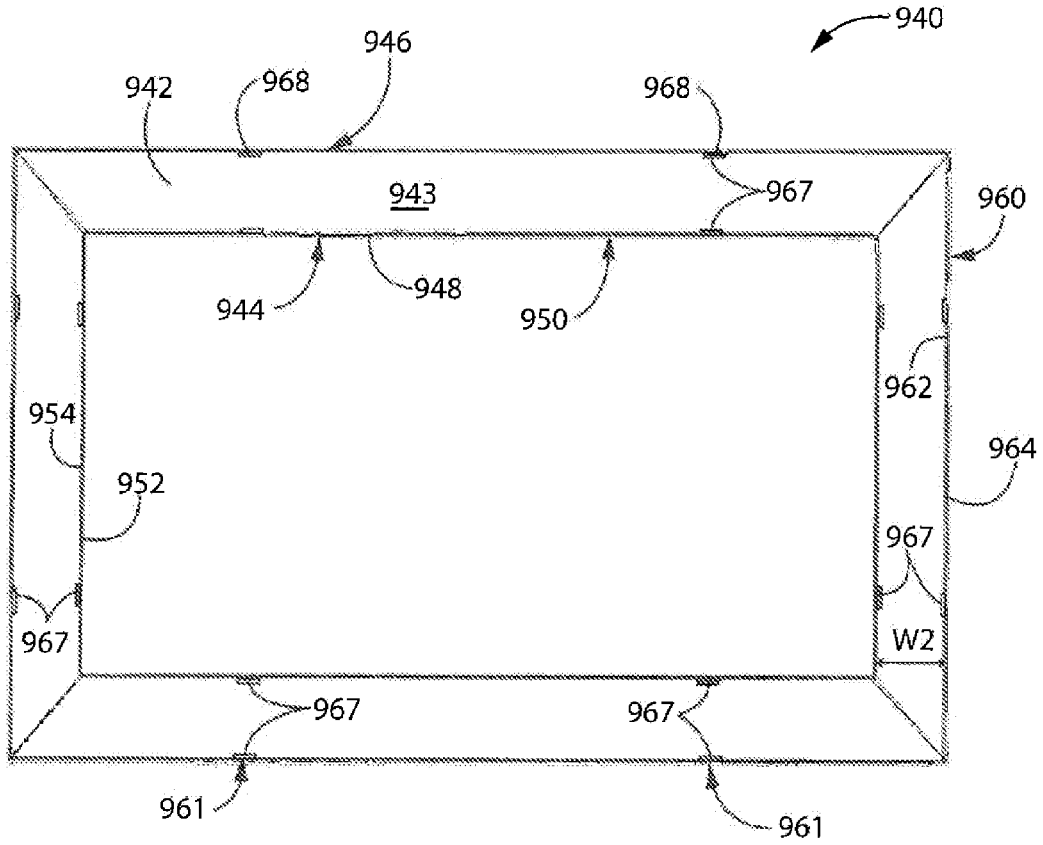
FIG. 23 is a rear elevation view of the front housing for the frame of FIG. 13.
Figure 24:
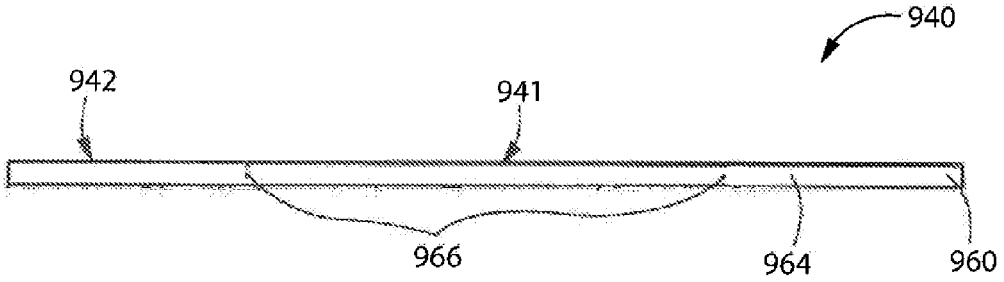
FIG. 24 is a bottom plan view of the front housing for the frame of FIG. 13.

It is contemplated that the rear housing 910 may be molded and formed as a single member. Optionally, the rear housing 910 may be formed from an extruded product. The extrusion is cut into pieces forming, for example, a first cross member 935, a second cross member 936, a first side member 937, and a second side member 938. As illustrated in FIG. 19, each of the extruded pieces may have mitered ends, such that each cross member 935, 936 joins each side member 937, 938 at the mitered end. Optionally, the extrusion may have straight edges and each of the extruded pieces may be joined, for example, with cross members 935, 936 extending beyond the ends of side members 937, 938, side members 937, 938 extending beyond the ends of cross members 935, 936, or a combination thereof. Each of the extruded pieces may be joined using any suitable method including, but not limited to, ultrasonic welding, vibration welding, or via a bracket spanning two extruded pieces. The rear housing 910 is preferably made from a plastic material with either a low or zero carbon content. For some displays 901, the rear housing 910 will be mounted over the receiver for a remote control. Carbon included in the plastic material interferes with transmission of the signal from the remote control to the receiver. Thus, it is desirable to manufacture the rear housing 910 from a material that has either a low or zero carbon content. The plastic material may be selected from, but is not limited to, one or more of the following materials: acrylic, polycarbonate, K-Resin®, styrene acrylonitrile (SAN), polypropylene, polyvinyl chloride (PVC), polycarbonate/acrylonitrile butadiene styrene (PC/ABS), low density polyethylene (LDPE), high density polyethylene (HDPE), polystyrene, polyethylene terephthalate glycol-modified (PETG), acrylonitrile butadiene styrene (ABS) and acrolite.

With reference to FIGS. 21-24, one embodiment of the front housing 940 is illustrated. The front housing 940 includes a planar surface 942 configured to fit around a video display. The planar surface 942 has an outer periphery 946 and an opening 948 which extends through the planar surface 942 defining an inner periphery 944 of the planar surface 942. It is contemplated that the opening 948 is sized such that the inner periphery 944 of the front housing 940 corresponds to the periphery of the video display around which the frame 900 will be mounted. The planar surface 942 includes an inner surface 943 configured to face toward the video display and an outer surface 941 configured to face away from the video display.

According to the illustrated embodiment, the front housing 940 includes a lip 950 protruding orthogonally from, and along the inner periphery 944 of, the planar surface 942. The lip 950 includes an inner surface 952 facing toward the opening 948 and an outer surface 954 facing toward the outer periphery 946 of the front housing 940. The lip 950 provides rigidity to the front housing 940 and may extend, for example, a distance equal to the thickness of one or both sides (902, 904) of the hook and loop fasteners. The lip 950 also provides a visual block so that the mounting system is not viewable from the inner periphery 944 of the frame 900

The front housing 940 also includes a wall 960 protruding orthogonally from, and along the outer periphery 946 of, the planar surface 942 in the same direction as the lip 950. The wall 960 includes an inner surface 962 facing toward the opening 948 and an outer surface 964 which is generally aligned with the outer periphery 946 of the front housing 940. The wall 960 may extend, for example, a distance sufficient to overlap, at least in part, a side of the video display 901 to which the front housing 940 is mounted. According to another embodiment of the invention, the wall 960 extends a distance no greater than the thickness of both sides (902, 904) of the hook and loop fasteners, allowing the hook and loop fasteners to engage each other yet providing a visual block so that the mounting system is not viewable from around the edge of the frame 900. The front housing 940 has a width, W2, defined by the inner surface 962 of the wall 960 and the outer surface 954 of the lip 950. The width, W2, of the front housing 940 is greater than the width, W1, of the rear housing 910 such that the rear housing 910 may be received between the lip 950 and the wall 960 of the front housing 940.

Figure 14:
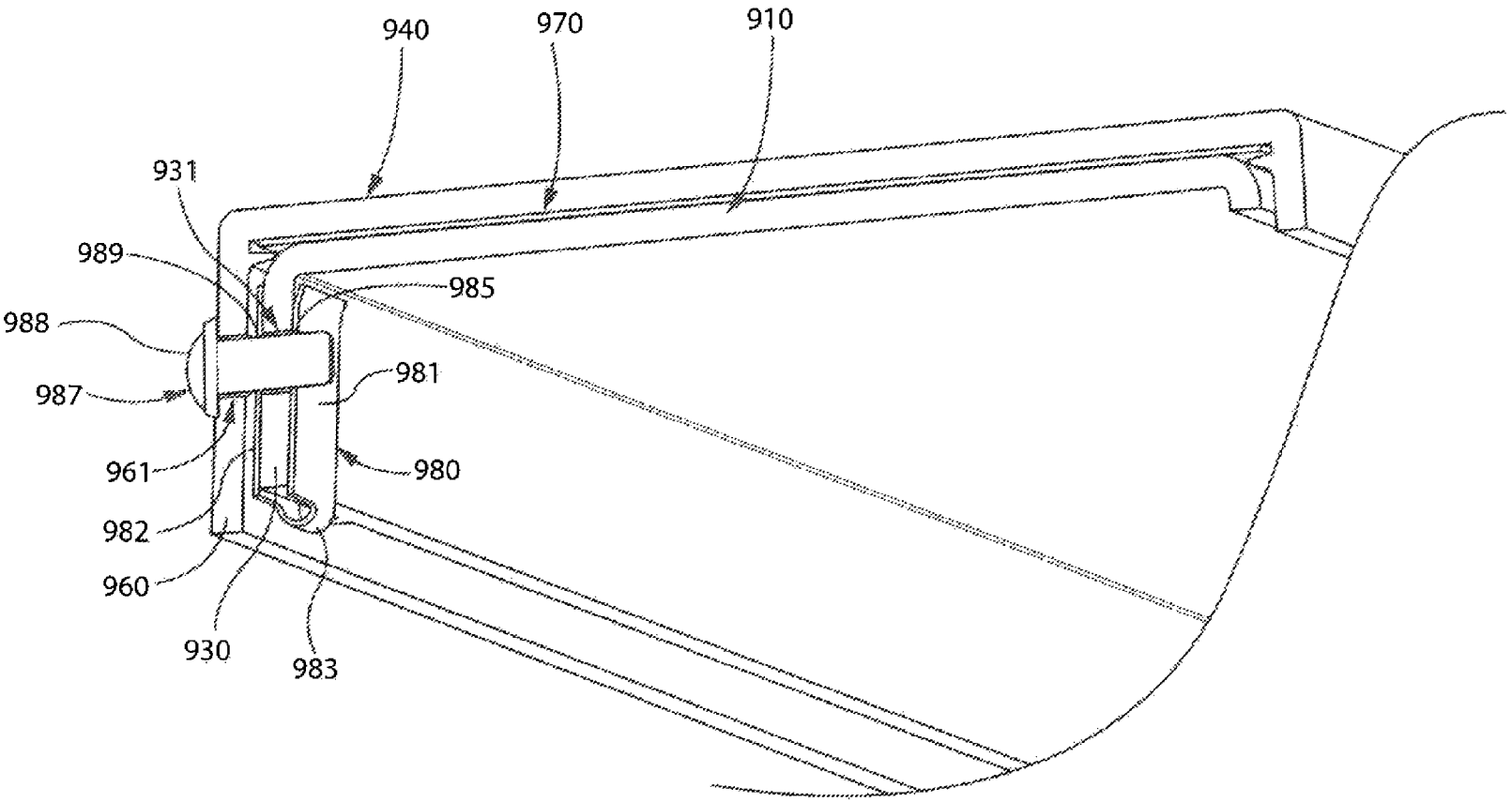
FIG. 14 is a sectional view of the frame of FIG. 13 at 14-14.

The front housing 940 also includes at least one shelf 967 configured to retain an advertising panel to the front housing 940. As also shown in FIGS. 14 and 15, the shelf 967 protrudes from the lip 950 and the wall 960 under the planar surface 942 of the front housing 940. According to the illustrated embodiment, multiple shelves 967 are provided, each extending for a short distance along the inner surface 962 of the wall 960 and the outer surface 954 of the lip 950. Optionally, a shelf 967 may be provided that extends along the entire wall 960 and/or a shelf 967 that extends along the entire lip 950. Various other combinations and configurations of the shelf 967 may be provided to retain the advertising panel to the inner surface 943 of the front housing 940.

Referring also to FIG. 15, the front housing 940 includes at least one tab 968. According to the illustrated embodiment, two tabs 968 protrude orthogonally from the end of the wall 960 opposite the planar surface 942. The wall 960 of the front housing 940 further extends beyond the wall 930 of the rear housing 910, and each tab 968 protrudes a distance substantially equal to the thickness of the wall 930 of the rear housing 910. Thus, the planar surface 942, the wall 960 of the front housing 940 and each tab 968 define a channel in which the wall 930 of the rear housing 910 may be received. It is contemplated that various numbers of tabs 968 may be distributed along the wall 960 of the front housing 940 or, optionally, a single tab 968 may extend along the wall 960. Preferably, the tabs 968 are located along a single side of the wall 930 and, as discussed in more detail below, retain the front housing 940 to the rear housing 910.

It is contemplated that the front housing 940 may be molded and formed as a single member. The front housing 940 is preferably made from a plastic material with either a low or zero carbon content. As discussed above with respect to the rear housing 910, for some displays 901, the front housing 940 will be mounted over the receiver for a remote control. Thus, it is desirable to manufacture the front housing 940 from a material that has either a low or zero carbon content. The plastic material may be selected from, but is not limited to, one or more of the following materials: acrylic, polycarbonate, K-Resin®, styrene acrylonitrile (SAN), polycarbonate/acrylonitrile butadiene styrene (PC/ABS), high density polyethylene (HDPE), and polystyrene.

With reference to FIGS. 26-31, another embodiment of the rear housing 910 is illustrated. The rear housing 910 includes a planar surface 912 configured to fit around a video display. The planar surface 912 has an outer periphery 916 and an opening 918 which extends through the planar surface 912 defining an inner periphery 914 of the planar surface 912. It is contemplated that the opening 918 is sized such that the inner periphery 914 of the rear housing 910 corresponds to the periphery of the video display around which the frame 900 will be mounted. The planar surface 912 includes an inner surface 913 configured to face toward the video display and an outer surface 911 configured to face away from the video display.

According to the illustrated embodiment, the rear housing 910 includes a lip 920 protruding orthogonally from, and along the inner periphery 914 of, the planar surface 912. The lip 920 includes an inner surface 922 facing toward the opening 918 and an outer surface 924 facing toward the outer periphery 916 of the rear housing 910. The lip 920 provides rigidity to the rear housing 910 and may extend, for example, a distance equal to the thickness of one or both sides 902, 904 of the hook and loop fasteners. According to another embodiment of the invention, the inner periphery 914 of the planar surface 912 may terminate in an edge having a squared or curved surface without a lip 920 protruding from the planar surface 912.

The rear housing 910 also includes a wall 930 protruding orthogonally from, and along the outer periphery 916 of, the planar surface 912 in the same direction as the lip 920. The wall 930 includes an inner surface 932 facing toward the opening 918 and an outer surface 934 which is generally aligned with the outer periphery 916 of the rear housing 910. The wall 930 may extend, for example, a distance sufficient to overlap, at least in part a side of the video display 901 to which the rear housing 910 is mounted. According to another embodiment of the invention, the wall 930 extends a distance no greater than the thickness of both sides 902, 904 of the hook and loop fasteners, allowing the hook and loop fasteners to engage each other yet providing a visual block so that the mounting system is not viewable from around the edge of the frame 900. The rear housing 910 has a width, W1, defined by the inner periphery 914 and the outer periphery 916 of the planar surface 912.

Figure 36:
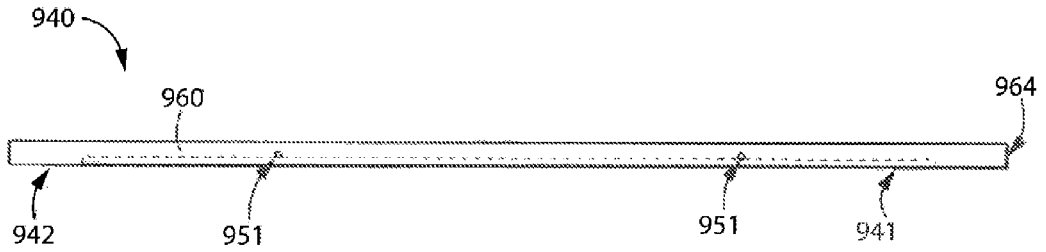
FIG. 36 is a top plan view of the front housing of FIG. 32.
Figure 38:
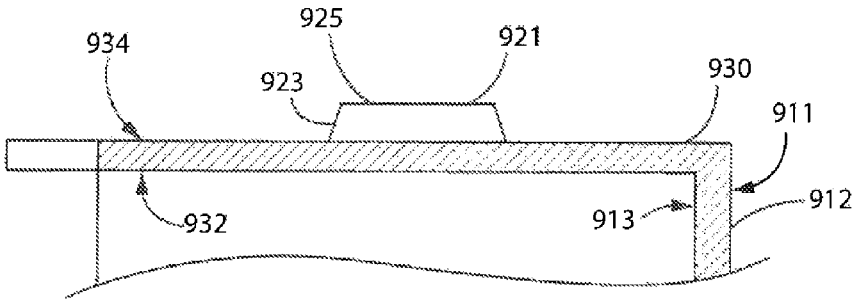
FIG. 38 is a partial sectional view of the rear housing of FIG. 26 taken at 38-38.

Referring also to FIG. 38, the rear housing 910 includes at least one boss 921 protruding from at least one surface of the wall 930. According to the illustrated embodiment, two bosses 921 extend from the top surface of the rear housing 910. Optionally, a boss 921 may protrude from each side of the rear housing 910. The boss 921 is configured to engage the front housing 940. With reference also to FIG. 36, the top surface of the front housing 940 may include an opening 951 configured to receive each of the bosses 921. Optionally, the bosses 921 may protrude from a single surface or opposite surfaces of the rear housing 910 a distance substantially equal to the difference in the widths of the front and rear housings 940, 910 to create a friction fit between the front and rear housings 940, 910. Each of the bosses 921 are configured to engage the corresponding opening 951 in the front housing 940 and/or a wall 960 of the front housing 940 to provide a first mechanical coupling between the front and rear housing 940, 910. Each boss 921 includes a sloped side surface 923 and a generally flat outer surface 925. The sloped side surface 923 allows the periphery of the outer surface 925 to be smaller than the periphery of the opening 951 in the front housing 940 to facilitate insertion of the boss 921 into the opening 951. The sloped side surface 923 further aids in alignment of the front housing 940 to the rear housing 910.

It is contemplated that the first mechanical coupling is configured to retain the front housing 940 to the rear housing 910 while allowing a user to manually remove the front housing 940 from the rear housing 910 with little effort and without the use of tools, for example, by lifting and/or pulling the front housing 940 from the rear housing 910. It is further contemplated that other configurations of the first mechanical coupling between the front housing 940 and the rear housing 910 may be utilized without deviating, from the scope of the invention. Preferably, the first mechanical coupling includes a first member located on the front housing 940 and a second member located on the rear housing 910 where each member is either integrally formed with or rigidly mounted to the respective housing such that neither member requires motion for the two members to engage.

It is contemplated that the rear housing 910 may be molded and formed as a single member. Optionally, the rear housing 910 may be formed from an extruded product. The extrusion is cut into pieces forming, for example, a first cross member 935, a second cross member 936, a first side member 937, and a second side member 938. As illustrated in FIG. 19, each of the extruded pieces may have mitered ends, such that each cross member 935, 936 joins each side member 937, 938 at the mitered end. Optionally, the extrusion may have straight edges and each of the extruded pieces may be joined, for example, with cross members 935, 936 extending beyond the ends of side members 937, 938, side members 937, 938 extending beyond the ends of cross members 935, 936, or a combination thereof. Each of the extruded pieces may be joined using any suitable method including, but not limited to, ultrasonic welding, vibration welding, or via a bracket spanning two extruded pieces. The rear housing 910 is preferably made from a plastic material with either a low or zero carbon content. For some displays 901, the rear housing 910 will be mounted over the receiver for a remote control. Carbon included in the plastic material interferes with transmission of the signal from the remote control to the receiver. Thus, it is desirable to manufacture the rear housing 910 from a material that has either a low or zero carbon content. The plastic material may be selected from, but is not limited to, one or more of the following materials: acrylic, polycarbonate, K-Resin®, styrene acrylonitrile (SAN), polypropylene, polyvinyl chloride (PVC), polycarbonate/acrylonitrile butadiene styrene (PC/ABS), low density polyethylene (LDPE), high density polyethylene (HDPE), polystyrene, polyethylene terephthalate glycol-modified (PETG), acrylonitrile butadiene styrene (ABS) and acrolite. Optionally, the rear housing 910 may include an opening 915 extending through the planar surface 912 and configured to align with the receiver for the remote control on the display.

According to another aspect of the invention, the rear housing 910 may be configured to be a magnetic or magnetic receptive material. During manufacture, a ferrous material, such as iron chips, may be mixed into the liquid or powdered plastic material prior to, or during, molding or extrusion. Once the rear housing 910 is formed, the ferrous material in the plastic and, therefore, the rear housing 910 is magnetic receptive, causing a magnetic material to be attracted to the rear housing 910. Optionally, any other material that causes the rear housing 910 to become magnetic receptive may be combined with the plastic during formation of the rear housing 910. Similarly, a magnetic material may be combined with the plastic during molding such that the rear housing 910 produces a magnetic field. Additional steps may be required during, manufacturing to establish the magnetic field, such as applying a strong magnetic field to the rear housing 910 and, in particular, to the ferrous material embedded in the plastic of the rear housing 910, in order for the rear housing 910 to become magnetic.

With reference to FIGS. 32-36, another embodiment of the front housing 940 is illustrated. The front housing 940 includes a planar surface 942 configured to fit around a video display. The planar surface 942 has an outer periphery 946 and an opening 948 which extends through the planar surface 942 defining an inner periphery 944 of the planar surface 942. It is contemplated that the opening 948 is sized such that, the inner periphery 944 of the front housing 940 corresponds to the periphery of the video display around which the frame 900 will be mounted. The planar surface 942 includes an inner surface 943 configured to face toward the video display and an outer surface 941 configured to face away from the video display.

According to the illustrated embodiment, the front housing 940 includes a lip 950 protruding orthogonally from, and along the inner periphery 944 of, the planar surface 942. The lip 950 includes an inner surface 952 facing toward the opening 948 and an outer surface 954 facing toward the outer periphery 946 of the front housing 940. The lip 950 provides rigidity to the front housing 940 and may extend, for example, a distance equal to the thickness of one or both sides (902, 904) of the hook and loop fasteners. The lip 950 also provides a visual block so that the mounting system is not viewable from the inner periphery 944 of the frame 900

The front housing 940 also includes a wall 960 protruding orthogonally from, and along the outer periphery 946 of, the planar surface 942 in the same direction as the lip 950. The wall 960 includes an inner surface 962 facing toward the opening 948 and an outer surface 964 which is generally aligned with the outer periphery 946 of the front housing 940. The wall 960 may extend, for example, a distance sufficient to overlap, at least in part, a side of the video display 901 to which the front housing 940 is mounted. According to another embodiment of the invention, the wall 960 extends a distance no greater than the thickness of both sides (902, 904) of the hook and loop fasteners, allowing the hook and loop fasteners to engage each other yet providing a visual block so that the mounting system is not viewable from around the edge of the frame 900. The front housing 940 has a width, W2, defined by the inner surface 962 of the wall 960 and the outer surface 954 of the lip 950. The width, W2, of the front housing 940 is greater than the width, W1, of the rear housing 910 such that the rear housing 910 may be received between the lip 950 and the wall 960 of the front housing 940.

It is contemplated that the front housing 940 may be molded and farmed as a single member. The front housing 940 is preferably made from a plastic material with either a low or zero carbon content. As discussed above with respect to the rear housing 910, for some displays 901, the front housing 940 will be mounted over the receiver for a remote control. Thus, it is desirable to manufacture the front housing 940 from a material that has either a low or zero carbon content. The plastic material may be selected from, but is not limited to, one or more of the following materials: acrylic, polycarbonate, K-Resin®, styrene acrylonitrile (SAN), polycarbonate/acrylonitrile butadiene styrene (PC/ABS), high density polyZethylene (HDPE), and polystyrene. Optionally, the front housing 940 may include an opening 945 extending through the planar surface 942 and configured to align with the receiver for the remote control on the display.

In operation, the frame 900 is mounted to a video display 901 to allow advertising to be displayed around the video display 901. The mounting system is first fit to the frame 900 and the display 901. Optionally, a first side (902, 904) of the hook and loop fastener may be mounted to the rear housing 910 upon assembly of the frame 900. The rear housing 910 is positioned around the display 901 and the second side (902, 904) of the hook and loop fastener mounted to the display 901 at the proper locations to engage the first side (902, 904) and retain the rear housing 910 to the display 901. Alternately, a set of hook and loop fasteners is provided with the frame 900. A customer may decide to mount the first side (902, 904) to either the rear housing 910 or the display 901 first according, for example, to the configuration of the display 901. The second side (902, 904) of the hook and loop fastener is then mounted to the other part (i.e., the rear housing 910 or the display 901) at the proper locations to engage the first side (902, 904) and retain the rear housing 910 to the display 901.

Figure 16:
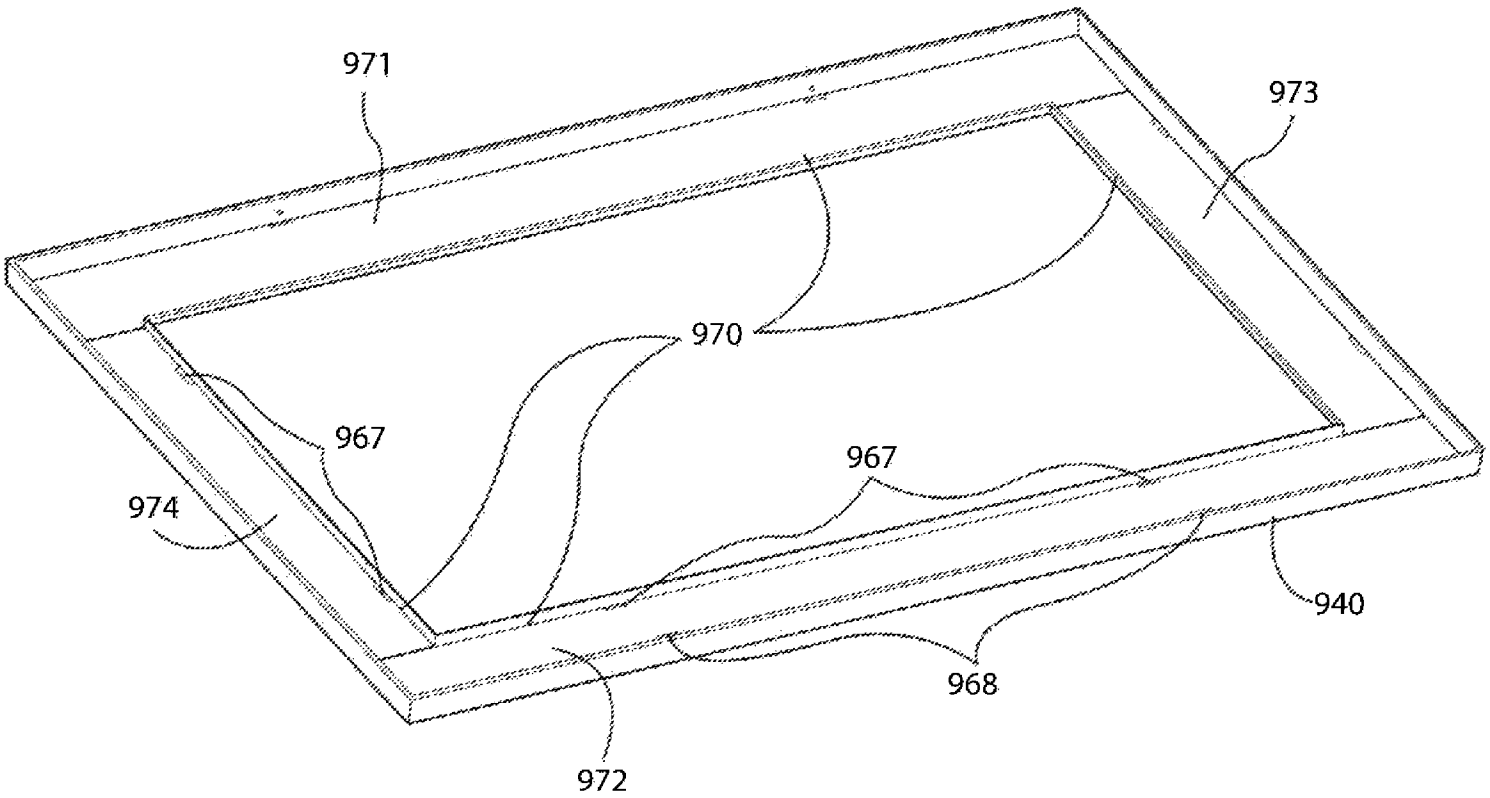
FIG. 16 is a perspective view of the frame of FIG. 13 with the rear housing removed.
Figure 17:
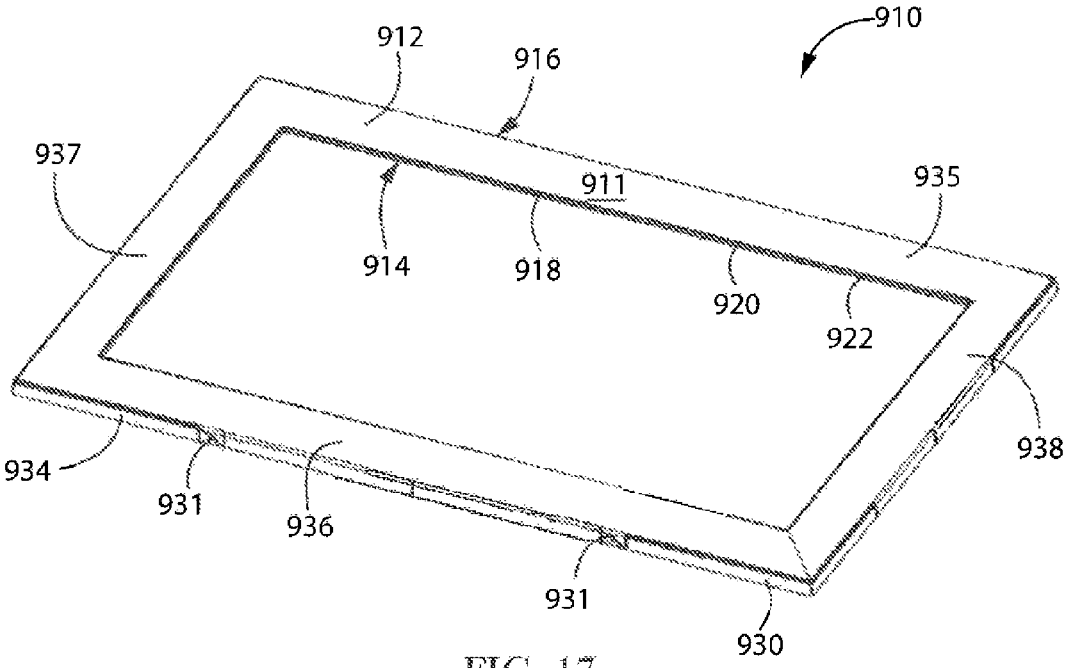
FIG. 17 is a perspective view of a rear housing for the frame of FIG. 13.
Figure 18:
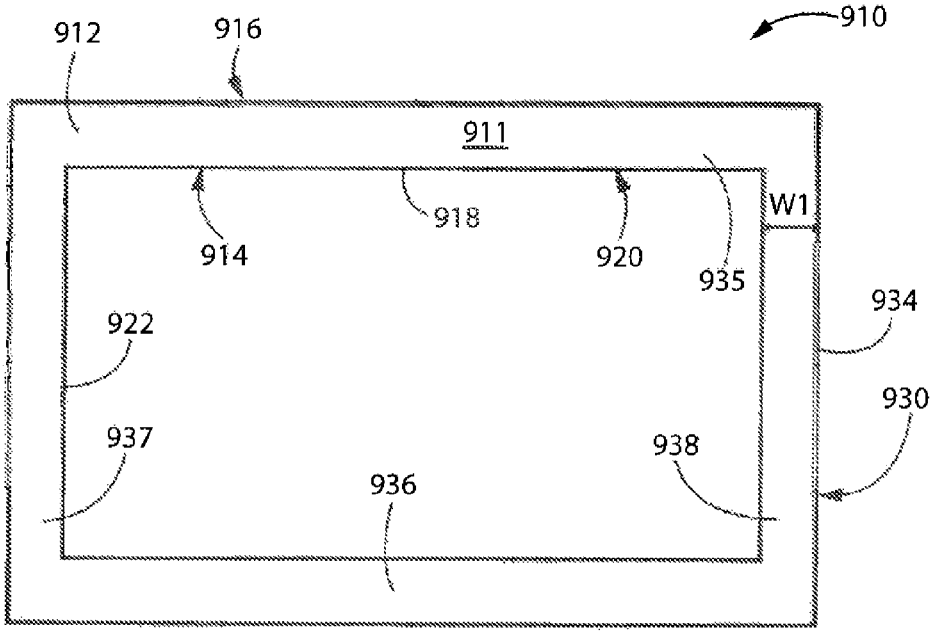
FIG. 18 is a front elevation view of the rear housing for the frame of FIG. 13.

With reference also to the embodiment illustrated in FIG. 16, an advertising panel 970 may then be inserted into the front housing 940. The advertising panel 970 includes a first cross member 971, a second cross member 972, a first side member 973, and a second side member 974. The advertising panel 970 may be constructed as a single panel and inserted into the front housing 940 or, optionally, one or more of the members (971, 972, 973, 974) may be separate pieces and each piece is inserted into the front housing 940. The advertising panel 970 is inserted between each shelf 967 and the inner surface 943 of the front housing 940. Because the advertising panel 970 is received between the front and rear housings 940, 910, it also will be mounted over the receiver for a remote control for some displays 901. Therefore, the advertising panel 970 is preferably made from a paper stock having a lighter weight to reduce interference with the signal transmitted from the remote to the receiver. According to one embodiment of the invention, the paper stock weight is 100 lb. or less. According to a more preferred embodiment of the invention, the paper stock weight is 65 lb. or less.

The front housing 940 is then mounted to the rear housing 910. According to the illustrated embodiment, the front housing 940 is lifted over and set down on the rear housing 910 such that the upper cross member (935 or 936) of the rear housing 910 fits between the inner surface 943 of the second planar surface 942 and the tab 968 protruding from the second wall 960 of the front housing 940. The front housing 940 rests on the rear housing 910 with the tab 968 preventing the front housing 940 from sliding off the rear housing 910. It is contemplated that other methods of mounting the front housing 940 to the rear housing 910 may be used without deviating from the scope of the invention. For example, a tab from either the front housing 940 or the rear housing 910 may insert into a complementary slot on the other housing.

Figure 37:
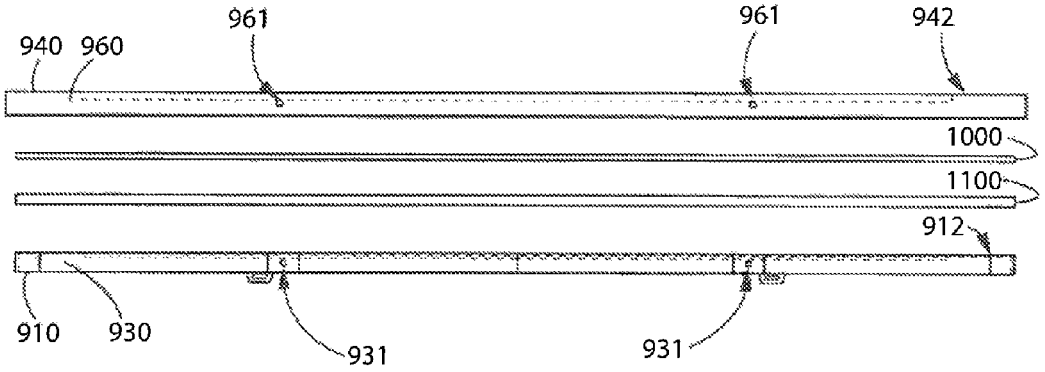
FIG. 37 is an exploded bottom plan view of the frame according to one embodiment of the invention.
Figure 39:
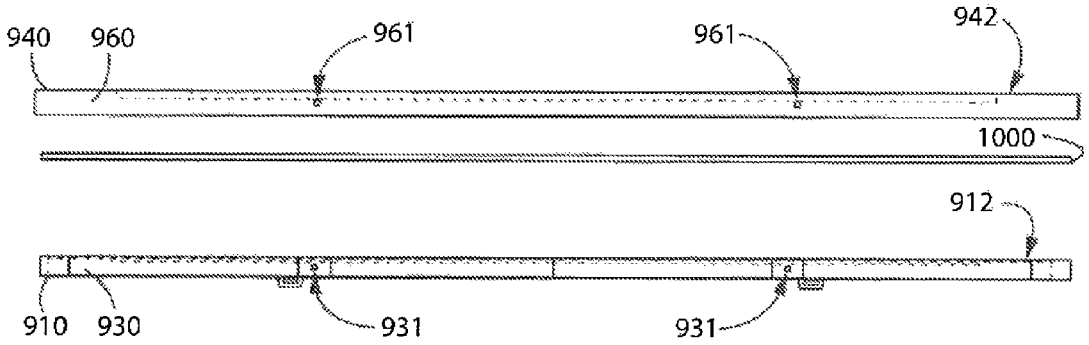
FIG. 39 is an exploded bottom plan view of the frame according to another embodiment of the invention.

According to another embodiment of the invention, it is contemplated that the frame 900 utilizes magnetic and magnetic receptive materials to secure the advertising panel in the frame. Referring to FIG. 37, a first sheet material 1100 is inserted in or mounted to the rear housing 910 of the frame. The first sheet material 1100 is preferably a magnetic receptive material and is mounted to the rear housing 910 by an adhesive. A second sheet material 1000 is magnetic and includes a graphic printed on one side of the sheet material 1000. The second sheet material 1000 is placed over the first sheet material 1100 and, because the first sheet material 1100 is magnetic and the second sheet material 1000 is magnetic receptive, retained on the frame by magnetic attraction. The front housing 940 is then mounted over the rear housing 910, enclosing the first and second sheet materials 1100, 1000 between the front housing 940 and the rear housing 910. According to another embodiment of the invention, the first sheet material 1100 may be a magnetic material where the polarity of the first and second sheet materials 1100, 1000 are coordinated such that the two sheet materials are attracted to each other. Optionally, the rear housing 910 may also be magnetic receptive and, if the first sheet material 1100 is magnetic, the first sheet material may be magnetically mounted to the rear housing 910. According to yet another embodiment of the invention, the rear housing 910 may be constructed such that it is magnetic receptive, as discussed above. With reference to FIG. 39, when the rear housing 910 is magnetic receptive, the first sheet material 1100 may be omitted and the second sheet material 1000 may be mounted directly to the rear housing 910.

Figure 40:
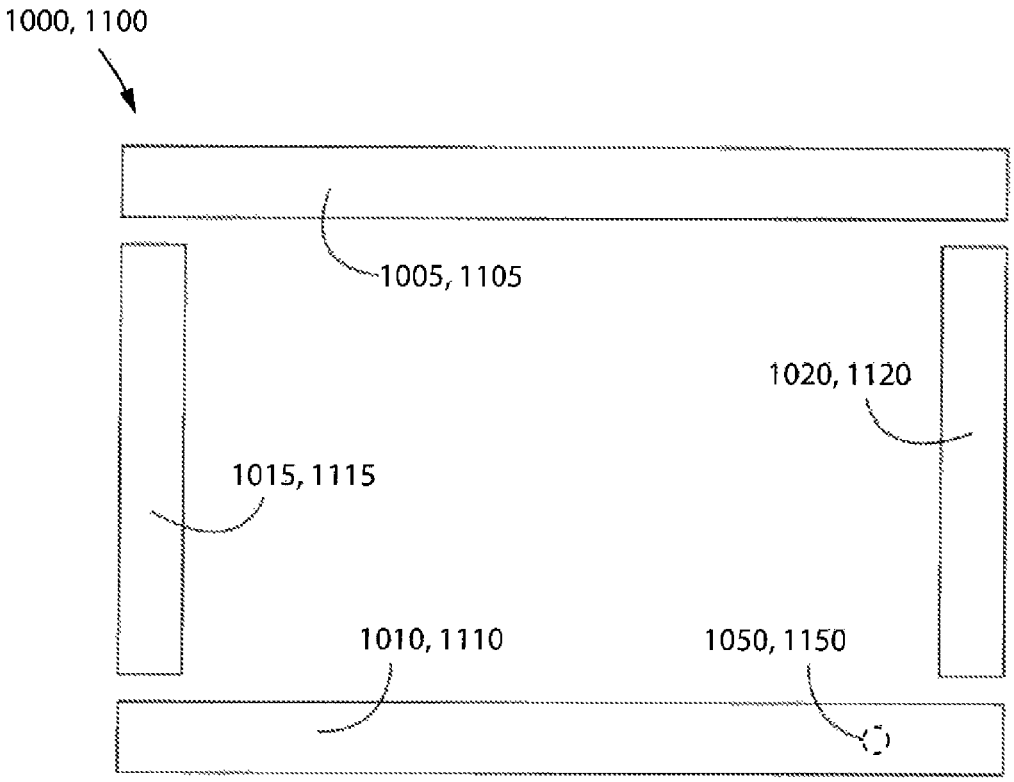
FIG. 40 is a front elevation view of magnetic and/or magnetic receptive sheet material used in one embodiment of the frame.
Figure 41:
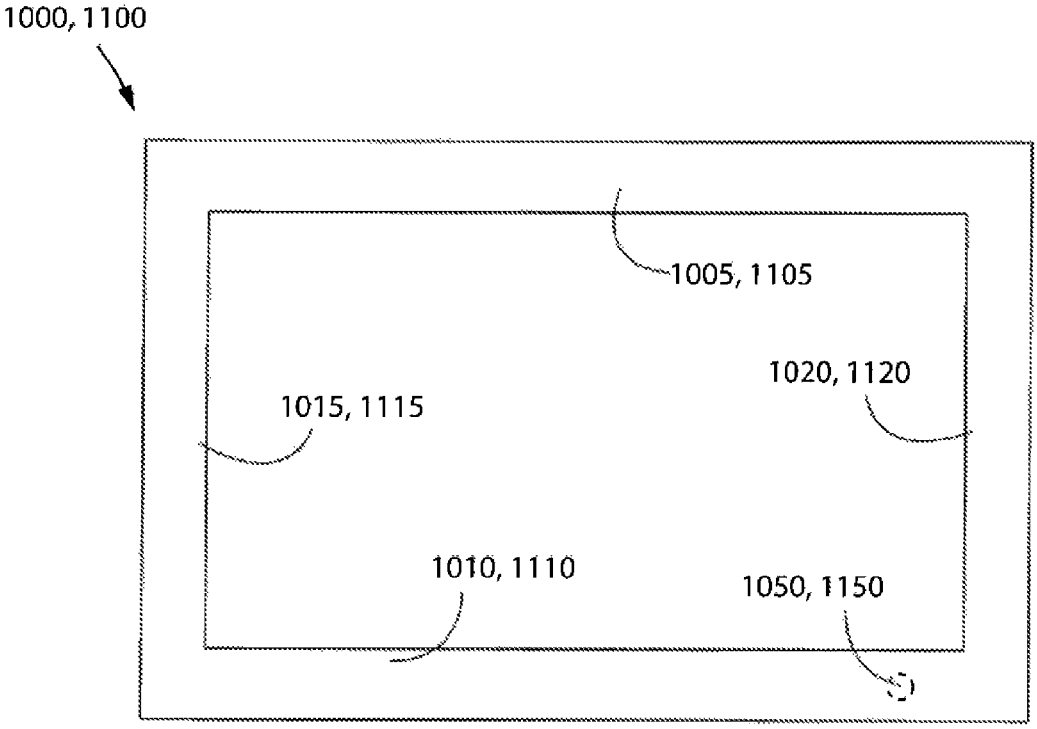
FIG. 41 is a front elevation view of magnetic and/or magnetic receptive sheet material used in another embodiment of the frame.

With reference next to FIGS. 40 and 41, it is contemplated that the first sheet material 1100 and the second sheet material 1000 may be constructed either as a single member, as illustrated in FIG. 41, or as components, as illustrated in FIG. 40.

With reference to FIG. 40, the first sheet material 1100 may include a first cross member 1105, a second cross member 1110, a first side member 1115, and a second side member 1120. It is contemplated that each of the members 1105, 1110, 1115, and 1120 may have straight edges, as illustrated, and each of the each of the members 1105, 1110, 1115, and 1120 may be joined, for example, with cross members 1105, 1110 extending beyond the ends of side members 1115, 1120; side members 1115, 1120 extending beyond the ends of cross members 1105, 1110; or a combination thereof. Optionally, each of the members 1105, 1110, 1115, and 1120 may have mitered ends, such that each cross member 1105, 1110 joins each side member 1115, 1120 at the mitered end. Still other shapes and configurations of joining members of the sheet material 1100 may be utilized without deviating from the scope of the invention.

Similarly, the second sheet material 1000 may include a second cross member 1005, a second cross member 1010, a second side member 1015, and a second side member 1020. It is contemplated that each of the members 1005, 1010, 1015, and 1020 may have straight edges, as illustrated, and each of the each of the members 1005, 1010, 1015, and 1020 may be joined, for example, with cross members 1005, 1010 extending beyond the ends of side members 1015, 1020; side members 1015, 1020 extending beyond the ends of cross members 1005, 1010; or a combination thereof. Optionally, each of the members 1005, 1010, 1015, and 1020 may have mitered ends, such that each cross member 1005, 1010 joins each side member 1015, 1020 at the mitered end. Still other shapes and, configurations of joining members of the sheet material 1000 may be utilized without deviating from the scope of the invention.

According to the embodiment illustrated in FIG. 37, a first sheet material 1100, which is magnetically receptive is mounted to the rear housing 910. An adhesive may be used to secure the first sheet material 1100 to the planar surface 912 of the rear housing 910. Adhesive may be applied either to the planar surface 912, the sheet material 1100, or a combination thereof. The first sheet material 1100 is positioned on the planar surface 912 and the adhesive is permitted to cure.

An advertising panel, in the form of the second sheet material 1000, is mounted to the first sheet material 1100. It is contemplated that the second sheet material 1000 may be a laminated material in which a first layer is a flexible magnetic material and the second layer is a material suitable for receiving a printed graphic. The advertisement is printed on the second layer and, optionally, may receive still another layer, such as a clear, protective layer over the printed graphic. The second sheet material 1000 is positioned with the magnetic layer adjacent to the first sheet material 1100 such that the magnetic attraction between the magnetic layer and the magnetic receptive material in the first sheet material 1100 operates to positively retain the second sheet material 1000 to the first sheet material 1100.

The front housing 940 is then mounted to the rear housing 910. A first mechanical coupling is provided to allow for a tool less connection of the front housing 940 to the rear housing 910, yet providing a retaining force between the front housing 940 to the rear housing 910. According to the illustrated embodiment, the rear housing 910 includes a pair of bosses 921 protruding from an upper surface of the wall 930 and the front housing 940 includes a pair of openings 951 configured to receive the bosses. The top surface 925 of each boss 921 preferably has a smaller periphery than the opening 951 in which is to be inserted to facilitate insertion. The tapered sides 923 of each boss then help align and may further provide a friction fit between the front housing 940 to the rear housing 910 when the front housing 940 fully engages the rear housing 910. It is contemplated that other configurations of tool less mechanical couplings may be utilized without deviating from the scope of the invention, such as tabs, tongues, grooves, spring clips, and the like. Preferably, the first mechanical coupling includes a first member located on the front housing 940 and a second member located on the rear housing 910 where each member is either integrally formed with or rigidly mounted to the respective housing such that neither member requires motion for the two members to engage, passively allowing the two members to be aligned and joined together.

A second mechanical coupling is provided that requires motion and preferably requires a tool to engage/disengage the front housing 940 to the rear housing 910. Requiring motion and/or a tool prevents inadvertent and/or unauthorized access to the sheet material within the frame 900. Further, the combination of the first and second mechanical coupling minimize the potential for inadvertent removal or falling off of the front housing 940 from the rear housing 910. With reference to FIG. 14, the second mechanical coupling may include, for example, a clip 980 and a pin 987, such as a screw. Optionally, the second mechanical coupling may include, for example, a cam-lock which is rotatable. It is contemplated that the rotatable portion may be rotated either by hand or with the use of a tool. While the tool helps prevent unauthorized access to the frame 900, the rotatable coupling still provides a more secure connection than the first mechanical coupling alone and helps prevent inadvertent removal of the front housing 940 from the rear housing 910.

The frame provides a system for displaying advertising around a display with secure mounting yet easy access and interchangeability of the advertising panels. Displays may often be mounted in the air for viewing by a large audience. The second mechanical coupling provides for secure mounting of the front housing 940 to the rear housing 910, preventing the front housing 940 from inadvertently becoming detached from the rear housing 910 and falling to the ground. Further, since access to the frame may require a ladder, the first mechanical coupling retains the front housing 940 to the rear housing 910 while the second mechanical coupling is being engaged/disengaged. Once the second mechanical coupling has been released, the front housing 940 may be lifted and/or pulled off the rear housing 910 and brought to the ground. The magnetic sheet material 1000, 1100 holds the advertising in place while the front housing 940 is being mounted and/or removed from the rear housing 910. With the front housing 940 removed, the existing second sheet material 1000, containing the printed advertising, may be removed from the frame 900 and replaced with new sheet material 1000, containing a new advertisement. The steps are reversed to reconnect the front housing 940 to the rear housing 910. When the front housing 940 is remounted to the rear housing 910, the sheet material 1100 with the advertising is protected from damage and/or unauthorized removal.

With reference also to FIG. 16 and according to another embodiment of the invention, an advertising panel 970 may be inserted into the front housing 940. The advertising panel 970 includes a first cross member 971, a second cross member 972, a first side member 973, and a second side member 974. The advertising panel 970 may be constructed as a single panel and inserted into the front housing 940 or, optionally, one or more of the members (971, 972, 973, 974) may be separate pieces and each piece is inserted into the front housing 940. The advertising panel 970 is inserted between each shelf 967 and the inner surface 943 of the front housing 940. Because the advertising panel 970 is received between the front and rear housings 940, 910, it also will be mounted over the receiver for a remote control for some displays 901. Therefore, the advertising panel 970 is preferably made from a paper stock having a lighter weight to reduce interference with the signal transmitted from the remote to the receiver. According to one embodiment of the invention, the paper stock weight is 100 lb. or less. According to a more preferred embodiment of the invention, the paper stock weight is 65 lb. or less.

The front housing 940 is then mounted to the rear housing 910. According to the illustrated embodiment, the front housing 940 is lifted over and set down on the rear housing 910 such, that the upper cross member (935 or 936) of the rear housing 910 fits between the inner surface 943 of the second planar, surface 942 and the tab 968 protruding from the second wall 960 of the front housing 940. The front housing 940 rests on the rear housing 910 with the tab 968 preventing the front housing 940 from sliding off the rear housing 910. It is contemplated that other methods of mounting the front housing 940 to the rear housing 910 may be used without deviating from the scope of the invention. For example, a tab from either the front housing 940 or the rear housing 910 may insert into a complementary slot on the other housing.

With reference to FIG. 14, the frame 900 may include a fastener to further secure the front housing 940 to the rear housing 910. According to the illustrated embodiment, the fastener includes a clip 980 and a pin 987, such as a screw. The clip 980 includes a first side 981 and a second side 982, where the second side 982 is spaced apart from and generally parallel to the first side 981. A base 983 connects one end of the first side 981 to one end of the second side 982, such that the first side 981, second side 982, and base 983 form a u-shaped clip. Both the first side 981 and the second side 982 of the clip have an opening 985 extending through the side, where the opening 985 in the first side 981 is aligned with the opening 985 in the second side 982. The first and second sides 981, 982 are spaced apart a sufficient distance such that the clip 980 may be slid on to the first wall 930. Optionally, the base 983 is configured to bias the first side 981 toward the second side 982. The end of the clip 980 opposite the base 983 is slid on to the first wall 930 forcing the first side 981 away from the second side 982. The biasing force of the base 983 helps retain the clip 980 on the first wall 930.

Each of the first wall 930 and the second wall 960 also have an opening, 931 and 961 respectively, configured to receive the pin 987 of the clip 980. The clip 980 is slid on to the first wall 930 such that the opening 985 in each side of the clip aligns with the opening 931 in the first wall 930. When the front housing 940 is mounted to the rear housing 910, the opening 961 in the second wall 960 is aligned with each of the other openings. The pin 987 may be inserted through the openings to engage the clip 980 and positively retain the front housing 940 to the rear housing 910. One or both of the openings 985 in the clip 980 may be threaded or of sufficient diameter to engage a threaded portion 989 of the pin 987. Optionally, the clip 980 may also include a captive nut configured to engage the threaded portion 989 of the pin 987. The pin 987 also includes a head which may be slotted (e.g., a screw), hexagonal (e.g., a bolt), or include any other means to engage a tool for rotation of the pin 987 such that the threaded portion 989 of the pin 987 rotatably engages the openings in, the frame 900 and clip 980.

According to one embodiment of the invention, the frame 900 may be mounted around a video display 901 receiving a dedicated signal. The video display 901 may be, for example, in a store showing a commercial or displaying advertised specials. Alternately, the video display 901 may be outside, for example, at a gas pump. In either example, the video display 901 receives a dedicated video signal for display.

According to another embodiment of the invention, the frame 900 may be mounted around a video display 901 which includes a tuner, such as a television. The video display 901 may be controlled by a remote control. As previously discussed, the frame 900 and the advertising panel 970 are preferably constructed to permit an infrared and/or RF signal from the remote control to be transmitted through the frame 900 and the advertising panel 970. Optionally, one or more knockout panels may be included in the advertising panel 970 such that a knockout panel located in from of the receiver on the video display 901 may be removed prior to insertion in the frame 900. Similarly, the frame 900 may include an opening in the first planar surface and/or the second planar surface located in front of the receiver on the video display 901. The knockout panel and/or the opening prevent the advertising panel 970 and the frame 900, respectively, from interfering with the signal from the remote.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A system for displaying an advertisement around a periphery of a display, the system comprising:

a rear housing having a planar surface extending around the periphery of the display, the planar surface having an inner periphery and an outer periphery, wherein the inner periphery defines an opening extending through the rear housing and wherein the rear housing has a wall has protruding from the outer periphery toward the display;

a front housing having planar surface extending around the periphery, of the display, the planar surface having an inner periphery and an outer periphery, wherein:

the inner periphery defines an opening through the front housing, the outer periphery of the front housing has a wall protruding from the outer periphery toward the display, the wall on the front housing extends over the wall on the rear housing, and the front housing is configured to be selectively mounted to and removed from the rear housing; and a sheet material having a first side and a second side opposite the first side, wherein:

the sheet material substantially covers the surface of the rear housing and extends around the periphery of the display, the first side of the sheet material is one of a magnetic material and a magnetic receptive material, the advertisement is printed on the second side of the sheet material, the first side of the sheet material is magnetically mounted to the planar surface of the rear housing, and the second side of the sheet material is visible through the front housing when the front housing is mounted to the rear housing.

2. The system of claim 1 wherein the first side of the sheet material is magnetic and the rear housing is magnetic receptive.

3. The system of claim 1 wherein the sheet material is a first sheet material, the system further comprising a second sheet material mounted to the planar surface of the rear housing. wherein one of the first sheet material and the second sheet material is magnetic and the other one of the first sheet material and the second sheet material is magnetic receptive.

4. The system of claim 1 further comprising a first mechanical coupling configured to retain the front housing to the rear housing, wherein the first mechanical coupling is configured for tool less mounting and removal of the front housing with the rear housing.

5. The system of claim 4 further comprising a second mechanical coupling configured to retain the front housing to the rear housing, wherein the second mechanical coupling is configured to require a tool for mounting and removal of the front housing with the rear housing.

6. The system of claim 1 further comprising a hook and loop fastener system wherein one of a hook portion of the hook and loop fastener system and a loop portion of the hook and loop fastener system is mounted to the rear housing and the other of the hook portion and the loop portion is mounted to the periphery of the display.

7. The system of claim 1 wherein the front housing is made of an optical grade clear polymer.

8. The system of claim 1 wherein at least one of the sheet material and the rear housing includes an opening corresponding to a receiver for a remote control for the display.

9. A system for displaying an advertisement around a periphery of a display, the system comprising:

a rear housing haying a first width and including a first planar surface extending around the periphery of the display, the planar surface having an inner periphery and an outer periphery, wherein the inner periphery defines an opening extending through the first planar surface and wherein the rear housing has a wall protruding from the outer periphery toward the display:

a front housing having a second width and including a second planar surface extending around the periphery of the display, the planar surface having an inner periphery and an outer periphery, wherein the inner periphery defines an opening extending through the second planar surface, the second width is greater than the first width, the outer of the front housing has a wall protruding from the outer periphery toward the display, and the front housing is configured to be selectively mounted to and removed from the rear housing; and a sheet material having a first side and a second side opposite the first side, wherein:

the sheet material substantially covers the planar surface of the rear housing and extends around the periphery of the display, the first side of the sheet material is one of a magnetic material and a magnetic receptive material, the advertisement is printed on the second side of the sheet material, and the first side of the sheet material is mounted to the first planar surface.

10. The system of claim 9 wherein the sheet material is magnetic and the rear housing is magnetic receptive.

11. The system of claim 9 wherein the sheet material is a first sheet material, the system further comprising a second sheet material mounted to the first planar surface wherein one of the first sheet material and the second sheet material is magnetic and the other one of the first sheet material and the second sheet material is magnetic receptive.

12. The system of claim 9 wherein the sheet material is a first sheet material, the system further comprising a second sheet material wherein:

the second sheet material is magnetic receptive and is adhesively mounted to the first planar surface, the first sheet material is magnetic, and the first sheet material is magnetically mounted to the second sheet material such that the advertisement is visible through the front housing when the front housing is mounted to the rear housing.

13. The system of claim 9 further comprising:

a first mechanical coupling configured to retain the front housing to the rear housing, wherein the first mechanical coupling is configured for tool less mounting and removal of the front housing with the rear housing; and a second mechanical coupling configured to retain the front housing to the rear housing, wherein the second mechanical coupling is configured to require a tool for mounting and removal of the front housing with the rear housing.

14. The system of claim 9 wherein at least one of the sheet material and the rear housing includes an opening corresponding to a receiver for a remote control for the display.

15. A system for displaying an advertisement around a periphery of a display, the system comprising:

a rear housing having a first width and including a first planar surface with an outer periphery and an inner periphery defining a first opening extending through the first planar surface, wherein:

the first opening corresponds to the periphery of the display, and the rear housing is made from a magnetic receptive material; and a front housing having a second width and including a second planar surface with an outer periphery and an inner periphery defining a second opening extending through the second planar surface, wherein:

the second width is greater than the first width, the second opening corresponds to the periphery of the display, and the front housing is configured to be selectively mounted to and removed from the rear housing.

16. The system of claim 15 further comprising a magnetic sheet material having a first side and a second side opposite the first side, wherein:

the magnetic sheet material substantially covers the planar surface of the rear housing and extends around the periphery of the display, the first side of the sheet material is a magnetic material configured to magnetically mount to the first planar surface, and the advertisement is printed on the second side of the sheet material.

17. The system of claim 16 wherein the advertisement is visible through the front housing when the front housing is mounted to the rear housing.

18. The system of claim 16 further comprising:

a first mechanical coupling configured to retain the front housing to the rear housing, wherein the first mechanical coupling is configured for tool less mounting and removal of the front housing with the rear housing; and a second mechanical coupling configured to retain the front housing to the rear housing, wherein the second mechanical coupling is configured to require a tool for mounting and removal of the front housing with the rear housing.

19. The system of claim 16 wherein at least one of the sheet material and the rear housing includes an opening corresponding to a receiver for a remote control for the display.

* * * * *